US006131307A

United States Patent [19]

Komino et al.

[11] Patent Number: 6,131,307

[45] Date of Patent: Oct. 17, 2000

[54] METHOD AND DEVICE FOR CONTROLLING PRESSURE AND FLOW RATE

[75] Inventors: Mitsuaki Komino, Nakano-ku; Osamu Uchisawa; Yasuhiro Chiba, both of Sendai, all of Japan

[73] Assignees: Tokyo Electron Limited, Tokyo-to; Motoyama Eng. Works, Ltd., Miyagi-ken, both of Japan

[21] Appl. No.: 09/129,760

[22] Filed: Aug. 5, 1998

[30] Foreign Application Priority Data

Aug. 7, 1997 [JP] Japan ..... 9-225841
Aug. 5, 1998 [JP] Japan ..... 10-221187

[51] Int. Cl.[7] ..... F26B 3/00

[52] U.S. Cl. ..... 34/486; 34/497

[58] Field of Search ..... 34/527, 548, 562, 34/486, 497, 210, 255, 258

[56] References Cited

U.S. PATENT DOCUMENTS 4,907,493 3/1990 Bellanger et al. ..... 91/361
5,315,766 5/1994 Robertson, Jr. et al. ..... 34/409
5,571,337 11/1996 Mohindra et al. ..... 134/25.4

FOREIGN PATENT DOCUMENTS 4-352326 12/1992 Japan .
61-86815 5/1996 Japan .

*Primary Examiner*—William Doerrler
*Assistant Examiner*—Malik N. Drake
*Attorney, Agent, or Firm*—Smith, Gambrell & Russell, LLP

[57] ABSTRACT

A pressure and flow rate of a gas flowing into or out of a processing chamber are controlled, so as to decrease or increase an atmosphere in the processing chamber higher or lower than a target pressure to obtain a target pressure. During a first period, an opening speed of an opening degree adjusting device provided in an inlet pipe communicating to the processing chamber is controlled to a first target value toward a first predetermined functional approximation line (for example a function of second degree) as ideal value. During the rest of periods other than the first period, the opening speed is controlled stepwise to two or more predetermined target values so that the processing chamber reaches the target pressure. During a period before the first period, the opening speed may be controlled to a second target value among the two or more target values, based on a control amount for the opening degree adjusting device. During another period after the first period, the opening speed may be controlled toward a second predetermined functional approximation line (e.g., linear) as ideal value, which has a larger change than the first functional approximation line, until the second target value reaches the target pressure.

16 Claims, 18 Drawing Sheets

METHOD AND DEVICE FOR CONTROLLING PRESSURE AND FLOW RATE

BACKGROUND OF THE INVENTION

This invention relates to a method and device for controlling pressure and flow rate.

In general, a cleaning method has widely been employed in the manufacturing process of a semiconductor production line in which such objects to be processed as semiconductor wafers and glass plates for LCD (hereinafter referred simply to wafer, etc.) are successively immersed in process tanks that include chemicals, cleaning solvents and other processing liquids. Such cleaning devices are provided with a drying device, in which the surface of cleaned wafers, etc. are exposed to dry gas consisting of volatile solvent, such as IPA (isopropyl alcohol), vapor to condense or adsorb the vapor, thus removing moisture on the wafers for drying.

FIG. 22 shows a typical drying device of this kind according to the prior art, which consists of a processing chamber "a" accommodating a plurality (e.g. 50 sheets) of wafers "W" and a steam generator "d" connected to the processing chamber "a" through a dried gas supply pipe line "c" communicating to a dried gas supply nozzle "b" disposed in the processing chamber "a". The dried gas supply pipe line "c" has an operating unit "j" therein, which consists of two parallel pipe lines "g" and "i". The first pipe line "g" includes a losing valve "e" and a needle valve "f", and the second pipe line "i" includes a losing valve "h". A supply source "k" of carrier gas (e.g. $N_2$) and a supply source "m" of drying gas (e.g. isopropyl alcohol) are connected to the steam generator "d".

To prevent wafers from damaging caused by an abrupt supply of drying gas into the processing chamber "a" so as to bring the pressure of the processing chamber "a" (which has been depressurized) to a target pressure (e.g., atmospheric pressure), the drying device of this kind according to the prior art has following two steps: The first step opens the valve "e" and the needle valve "f" in the first line "g" to supply a small amount of drying gas into the processing chamber "a". Then, the second step opens the valve "h" in the second line "i" to supply the drying gas into the processing chamber "a".

However, because, as soon as the valve "e" is opened in the first step, the drying gas flows into the processing chamber "a" which has been depressurized with one atmospheric pressure differential, as shown in FIG. 23, the opening of the valve "e" creates a spike-like high-speed flow. The created spike-like high-speed flow causes particles to rise, resulting in attaching to wafers "W". Further, also when the first line "g" is switched over the second line "i", the spike-like high-speed flow is created in the same way, thus causing similar phenomenon.

Furthermore, also when a relatively large flow rate of drying gas supply is required in the processing chamber "a" under the target pressure such as atmospheric pressure, the large flow rate of drying gas supply into the processing chamber "a" may create a similar spike-like high-speed flow, thus resulting not only in causing the similar problem, but also in damaging of wafers "W" caused by the vibration.

In addition to the above dry processing, such problems as described above may arise in, for example, general systems in which fluids are supplied in a depressurized processing chamber, such as film making devices which make film under vacuum atmosphere. Furthermore, in cases where the processing chamber is over the target pressure such as atmospheric pressure, when the pressure is too abruptly depressurized, not only the gas in the processing chamber may instantly fluidized, thereby causing particles to rise, but also dew condensation of moisture in the gas due to its adiabatic expansion may cause particles to attach to wafers, etc.

SUMMARY OF THE INVENTION

A purpose of the invention is to provide a method and device for controlling pressure and flow rate, which can prevent objects to be processed in a processing chamber from damaging, by controlling the pressure of a gas while it is charged or vented in or from the processing chamber to bring a depressurized or atmospheric pressure in the processing chamber to a target pressure.

This invention provides a control method for pressure and flow rate by which a processing chamber under atmosphere higher or lower than the target pressure is restored to the target pressure, comprising the steps of: controlling, during a first period, an opening speed of an opening degree adjusting means provided in a pipe communicating to the processing chamber to a first target value toward a predetermined first functional approximation line as an ideal value; and controlling, during other periods except the first period, the opening speed stepwise to two or more predetermined target values to control a pressure and flow rate in the pipe so that the processing chamber reaches the target pressure.

Furthermore, this invention provides a control method for pressure and flow rate by which a processing chamber under atmosphere higher or lower than a target pressure is restored to the target pressure, comprising the steps of: when the processing chamber is under atmosphere lower than the target pressure, controlling an opening speed of a first opening degree adjusting means provided in an inlet pipe communicating to the processing chamber to a first target value toward a first predetermined functional approximation line as an ideal value during a first period; controlling the opening speed of the first opening degree adjusting means stepwise to two or more predetermined target values during periods other than the first period to control a pressure and flow rate in the inlet pipe so that the processing chamber reaches the target pressure, when the processing chamber is under atmosphere higher than the target pressure, controlling an opening speed of a second opening degree adjusting means provided in an outlet pipe communicating to the processing chamber to a second target value toward a second predetermined functional approximation line as an ideal value during a second period; and controlling the opening speed of the second adjusting means stepwise to two or more predetermined target values during periods other than the second period to control a pressure and flow rate in the outlet pipe, so that the processing chamber reaches the target pressure.

Furthermore, this invention provides a method for evacuating a processing chamber to vacuum comprising the step of supplying a thermal energy supplementary gas into the processing chamber.

Furthermore, this invention provides a control device for pressure and flow rate, comprising: opening degree adjusting means provided in an inlet pipe communicating to a processing chamber under atmosphere higher or lower than a target pressure; detection means for detecting a pressure in the processing chamber to output a detection signal; and control means, responsive to the detection signal, for controlling, an opening speed of the opening degree adjusting means to a first target value toward a first predetermined functional approximation line as ideal value during a first period and controlling the opening speed of the opening degree adjusting means stepwise to two or more predetermined target values to control a pressure and flow rate in the inlet pipe so that the processing chamber reaches the target pressure.

Furthermore, this invention provides control device for pressure and flow rate, comprising: first opening degree adjusting means provided in an inlet pipe communicating to a processing chamber under atmosphere lower or higher than a target pressure; second opening degree adjusting means provided in an outlet pipe communicating to the processing chamber; detection means for detecting a pressure in the processing chamber to output a detection signal; and control means for, when the processing chamber is under atmosphere lower than the target pressure, controlling a pressure and flow rate in the inlet pipe by controlling an opening speed of the first opening degree adjusting means, during a first period, to a first target value toward a first predetermined functional approximation line as ideal value, and during periods other than the first period, stepwise to two or more predetermined target values so that the processing chamber reaches the target pressure, and when the processing chamber is under atmosphere higher than the target pressure, controlling a pressure and flow rate in the outlet pipe by controlling an opening speed of second opening degree adjusting means, during a second period, to a second target value toward a second predetermined functional approximation line as ideal value, and during periods other than the second period, stepwise to two or more predetermined target values so that the processing chamber reaches the target pressure.

DETAILED DESCRIPTION OF THE PREFERRED EMBODIMENTS

The following is the detailed description of the embodiments according to the invention, referring to drawings: With these embodiments, description will be made for the application to a cleaning/drying processing system for semiconductor wafers.

Figure 1:
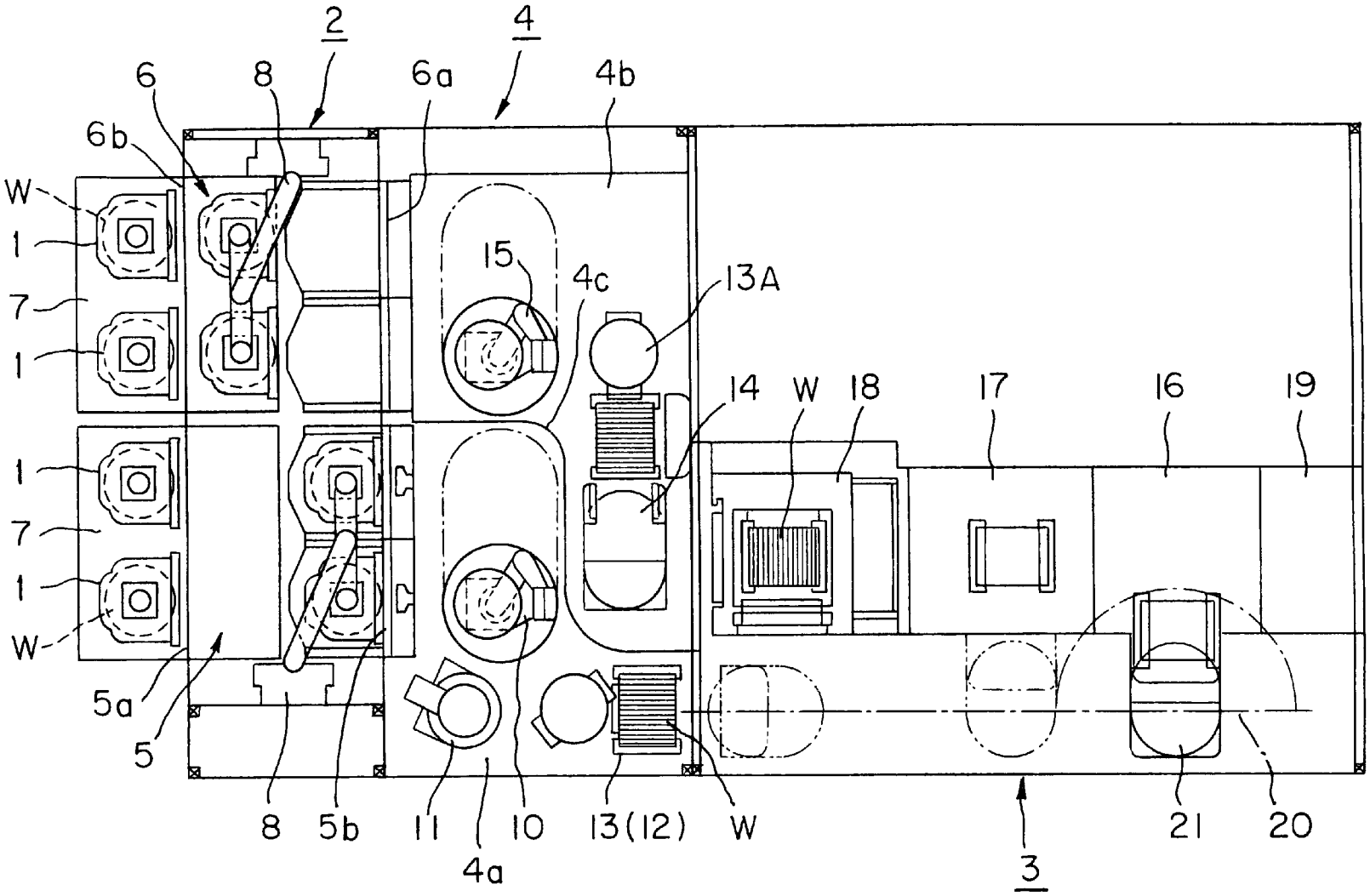
FIG. 1 is a schematic plan view showing a cleaning/drying processing system to the drying process portion of which a pressure control device related to the invention is applied.
Figure 2:
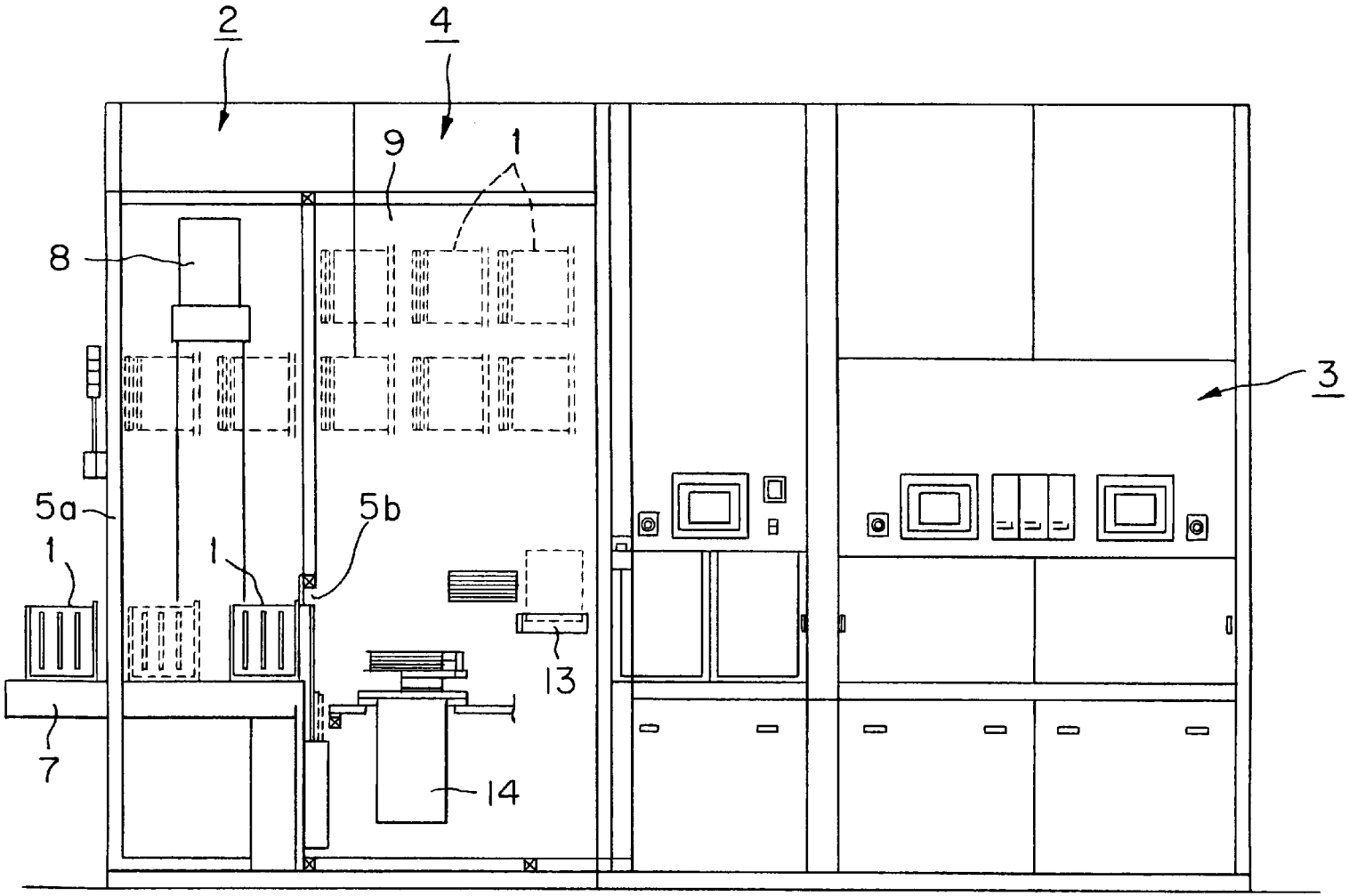
FIG. 2 is a schematic side view showing the above cleaning/drying processing system.

FIG. 1 is a schematic plan view showing a cleaning/drying processing system to the drying process portion of which a pressure and flow rate control device according to the invention is applied. FIG. 2 is a schematic side view showing the cleaning/drying processing system.

The cleaning/drying processing system consists mainly of a transfer section 2 which carries in/out carriers 1 for horizontally accommodating objects to be processed, that is, (in this case) semiconductor wafers W (hereinafter referred simply to wafers); a processing section 3 which processes wafers W with chemicals and cleaning agents and then dries them; and an interface section 4 which is located in between the transfer section 2 and the processing section 3 to make transfer, positional adjustment and posture change of wafers W.

The transfer section 2 consists of a carry-in portion 5 and a carry-out portion 6, both of which are provided at one side end portion of the cleaning/drying processing system. A slidable mounting table 7 is provided at a carry-in opening 5*a* and a carry-out opening 6*b* of the carrier 1 located at the carry-in portion 5 and carry-out portion 6 so as to be able to carry-in and carry-out the carrier 1. Carrier lifters 8 are provided at the carry-in opening 5*a* and carry-out opening 6*b*. The carrier lifter 8 can not only transfer a carrier 1 between the carry-in portions or between carry-out portions, but also hand over empty carriers 1 to a carrier standby portion 9 and receive carriers 1 from a carrier standby portion 9 (see FIG. 2).

The above interface section 4 is partitioned by a partition wall 4*c* into two chambers: The first chamber 4*a* adjoining to the carry-in portion 5 and the second chamber 4*b* adjoining to the carry-out portion 6. The first chamber 4*a* is provided with a wafer takeoff arm 10 which takes two or more wafers W out of the carrier 1 in the carry-in portion 5 to carry them in horizontal (X, Y) and vertical (Z) directions and rotate in θ direction; a notch aligner 11 to detect a notch stamped on wafers W; a spacing adjusting mechanism 12 to adjust the spacing of wafers W taken out by the wafer takeoff arm 10; as well as a first posture change device 13 changing wafers W from horizontal posture to vertical posture.

The second chamber 4*b* is provided with a wafer delivery arm 14 which receives two or more processed wafers W from the processing section 3 as is vertical for delivering to next portion; a second posture change device 13A to change the posture of wafers W receiving from the wafer delivery arm 15 from vertical to horizontal; and a wafer housing arm 15 which can move in the horizontal (X,Y) and vertical (Z) directions and rotate in the θ direction for receiving two or more horizontal wafers W and housing them into a empty carrier 1 already transferred to the carry-out section 6. The second chamber 4*b* is hermetically enclosed from outside, so as for the inside to be replaced by inert gas such as $N_2$ gas supplied from $N_2$ supply source.

In the process section 3, longitudinally lined up are a first processing unit 16 to remove particles and organic contamination attached to wafers W; a second processing unit 17 to remove metallic contamination attached to wafers W; a cleaning/drying unit 18 to remove oxide films attached to wafers W and to dry the oxide-removed wafers W; and a chuck cleaning unit 19. Furthermore, a wafer transfer arm 21 (transfer means) which can move in X, Y (horizontal) and Z (vertical) directions and rotate in the θ direction is provided on a transfer route 20 facing the units 16~19.

Figure 3:
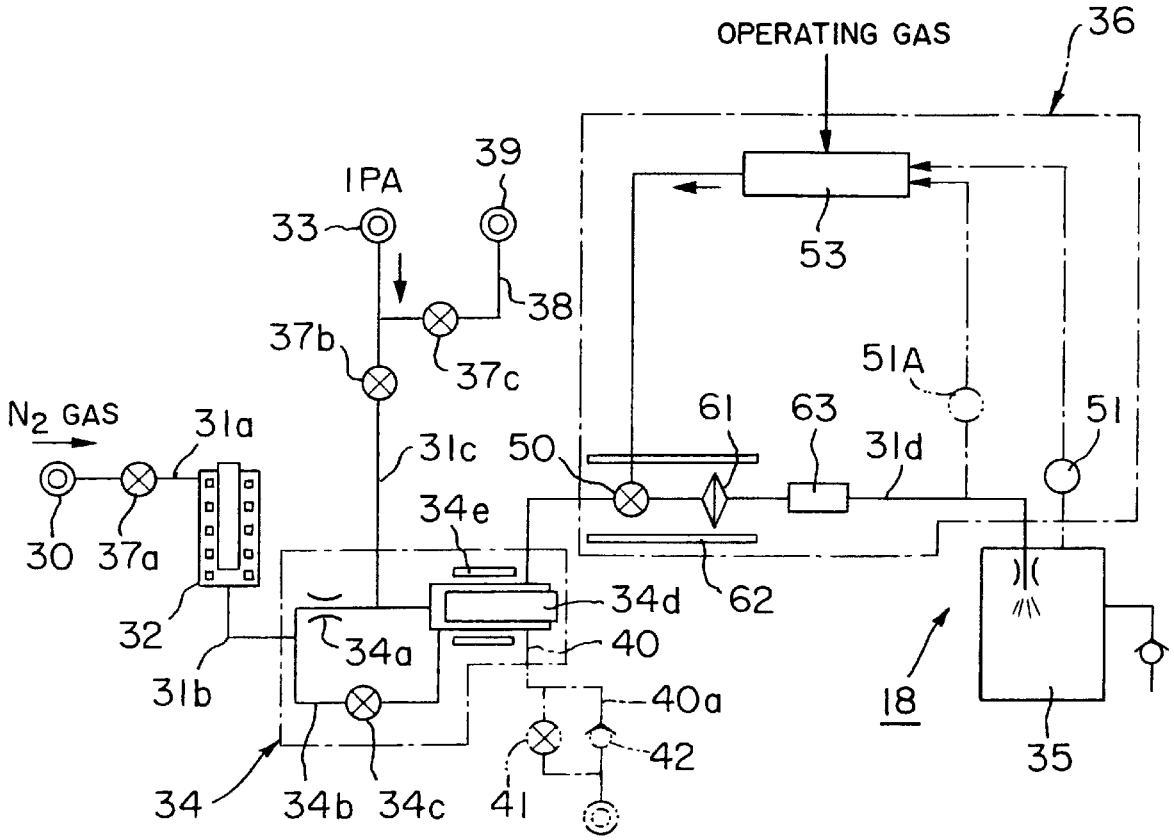
FIG. 3 is a schematic diagram showing a cleaning/drying processing unit to which a pressure/flow rate control device related to the invention is applied.

As shown in FIG. 3, the cleaning/drying unit 18 is provided with an $N_2$ gas heater (heating means) 32 (hereinafter referred simply to heater) connected to a supply source 30 of $N_2$ (carrier) gas via a supply line 31*a*; a steam generator 34 (steam generating means) which is connected not only to the heater 32 via a supply line 31*b*, but also to a supply source 33 of IPA (isopropyl alcohol as liquid for making drying gas) via a supply line 31*c*; a pressure and flow rate controller 36 (according to this invention) connected to the steam generator 34; and a drying processing chamber 35 (hereinafter referred simply to processing chamber) connected to the pressure/flow rate controller 36 via a drying gas supply line 31*d*.

A valve 37*a* is provided in the supply line 31*a* between the $N_2$ gas supply source 30 and the heater 32. A valve 37*b* is provided in a supply line 31*c* connecting the gas heater 32 and the IPA supply source 33. An IPA recovery chamber 39 is provided at the IPA supply source 33 side via a branch line 38 and a relief valve 37*c*. As shown by two-dot chain line, an IPA drain pipe 40 may be connected to the steam generator 34 if required. A drain valve 41 and a branch line 40*a* including a check valve 42 are connected to the drain pipe 40. Such provision of the drain pipe 40 and the drain valve 41 is preferable in venting cleaning liquid and the like when cleaning the inside of the steam generator 34.

The steam generator 34 is made mainly of pipe (e.g., stainless steel pipe) connected to the carrier gas supply line 31*b*. The pipe includes an orifice 34*a* therein for generating shock wave. The orifice 34*a* is formed with a taper section which is gradually decreased in width in the direction in which a carrier gas flows, and a divergent section which is gradually increased in width in that direction from a narrow portion of the taper section. The shock wave is generated by the pressure difference between pressure of entering flow (or primary pressure) and pressure of exiting flow (secondary pressure). For example, an adequate selection of primary pressure (kgf/cm$^2$G) and $N_2$ gas flow rate (N1/min) can generate shock wave. A pressure regulator 34*c* provided in a bypass line 34*b* directly connecting the primary and secondary sides of the orifice 34*a* can adequately control the generation of shock wave.

The IPA supply line 31*c* is connected to an IPA supply port formed in the midway of the divergent section of the orifice 34*a* so as to supply IPA from the IPA supply source 33. An internal heater 34*d* is inserted into a pipe provided at the outlet side of the dibergent seciton of the orifice 34*a*, and an outer heater 34*e* is wound around the pipe.

When IPA is supplied from the supply port of the orifice 34*a*, such above configuration can finely atomize IPA by the shock wave, thus generating IPA vapor by the heaters 34*a* and 34*e*.

Figure 4:
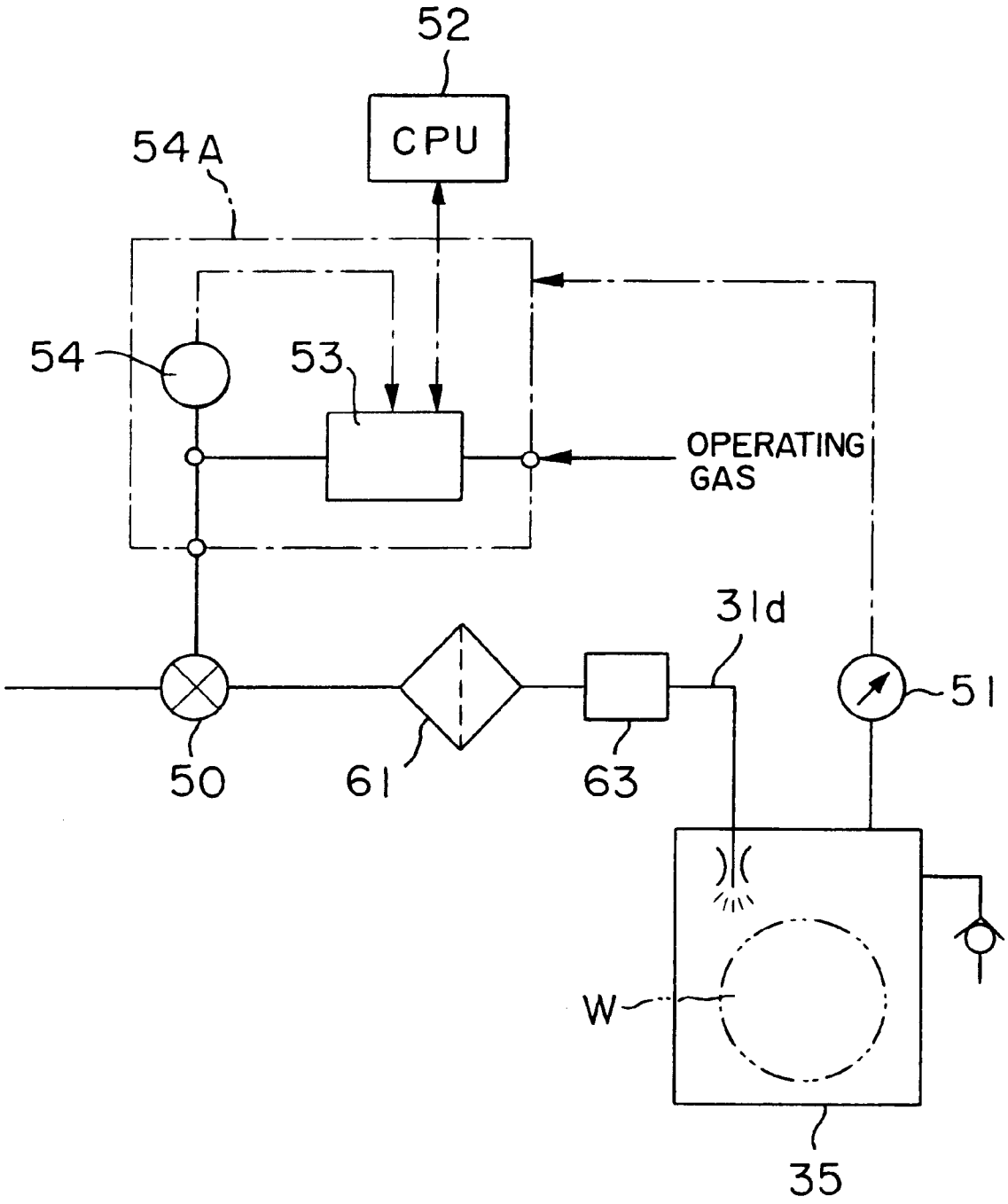
FIG. 4 is a schematic diagram showing the main section of a pressure control device according to the invention.

As shown in FIGS. 3 and 4, the pressure and flow rate controller 36 is provided therein with a diaphragm valve 50 (opening adjusting means) provided in the drying gas supply line 31*d*; CPU 52 (central processing unit) to compare a signal of a pressure sensor 51 (detection means) which detects a pressure in the processing chamber 35 and data stored therein previously, for calculation; a micro valve 53 (operating means) to control the opening of the diaphragm valve 50 based on the signal from the CPU 52; and a control board 54A (for the micro valve 53) which comprises a control circuit (not shown) and a pressure transducer 54 which detects the secondary pressure (operating signal) of the micro valve 53 and returns the detected pressure to the micro valve 53.

Figure 6A:
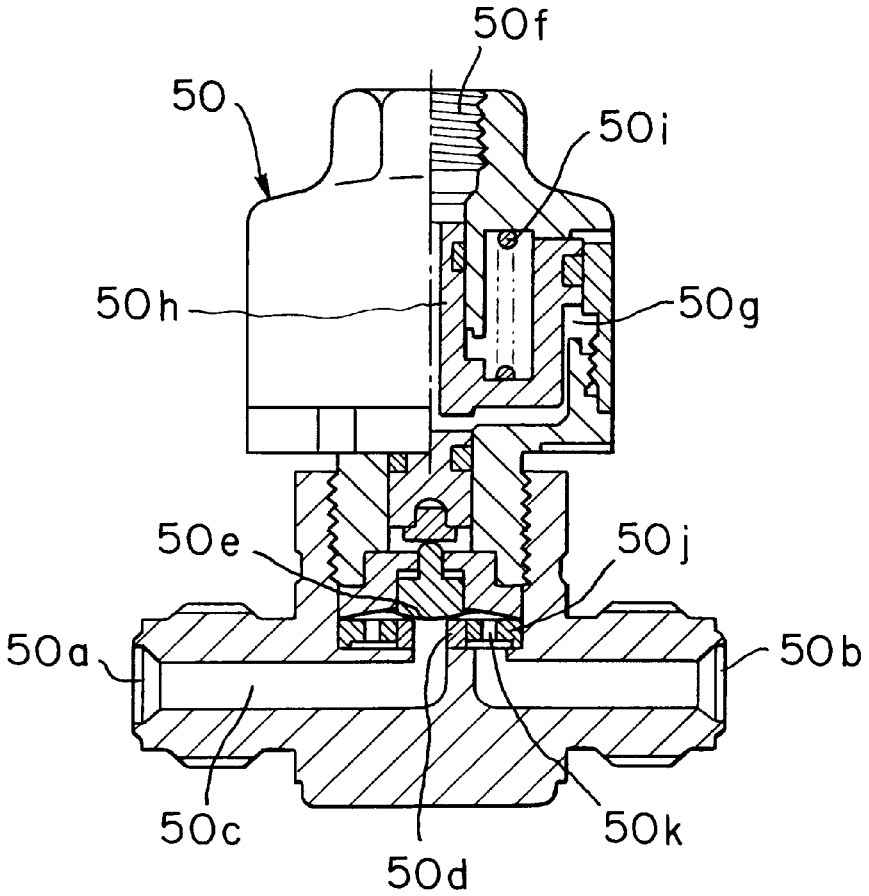
FIG. 6A is the sectional view showing the closed condition of the diaphragm valve in the above invention.
Figure 7A:
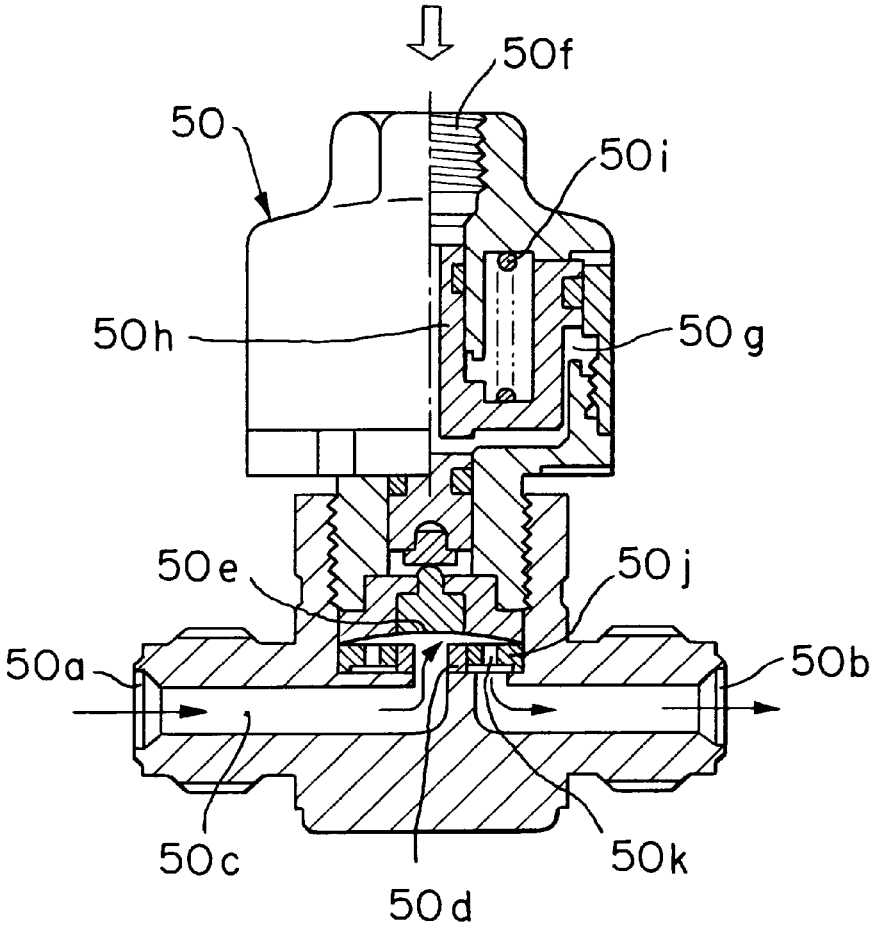
FIG. 7A is the sectional view showing the open condition of the diaphragm valve in the above invention.
Figure 7B:
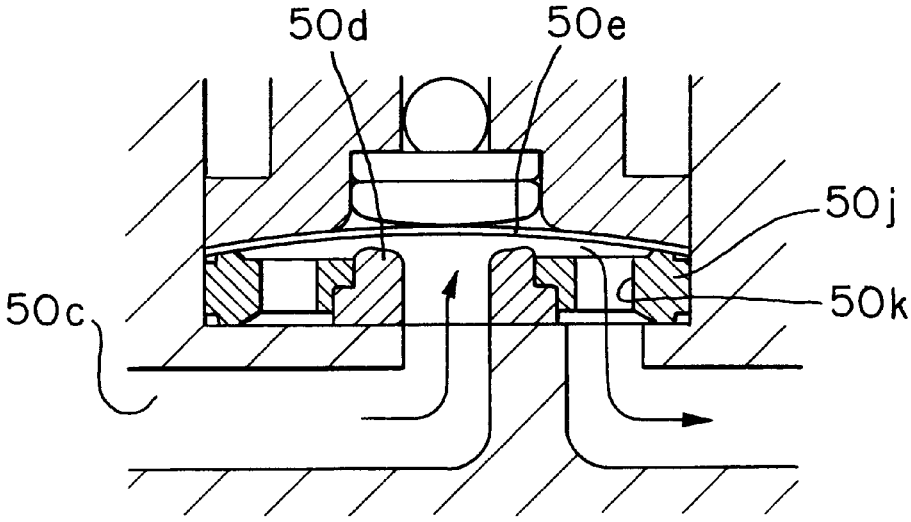
FIG. 7B is the enlarged sectional view showing the main section in the above invention.

As shown in FIGS. 6A and 7B, the diaphragm valve 50 has a valve seat 50*d* in the passage 50*c* communicating a primary port 50*a* connected to the drying gas supply line 31*d* and a secondary port 50*b*, and a vertically displaceable metal diaphragm 50*e* which can normally bulge to valve open side so as to seat on the valve seat 50*d*. Furthermore, the diaphragm valve 50 has a slidable operation adjusting valve body 50*h* in a chamber 50*g* communicating to the upper surface side of the metal diaphragm 50*e* and to a supply port 50*f* of air (operating fluid) opening upwards; and an operation adjusting spring 50*i* for always depressing the operation adjusting valve body 50*h* downwards. A compression force of the operation adjusting spring 50*i* always closes the metal diaphragm 50*e*. But, the metal diaphragm 50*e* is separated from the valve seat 50*c*, following the flow rate of air (operating fluid) flowing into a supply port 50*f*, so that the drying gas flows into a communication hole 50*k* opened in a seat holder 50*j* provided around the valve seat 50*c*.

Figure 6B:
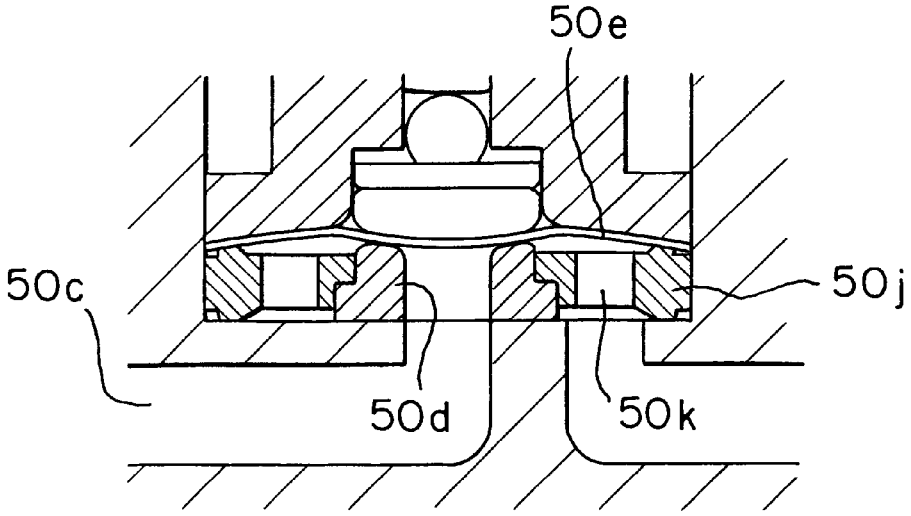
FIG. 6B is the enlarged sectional view showing the main section in the above invention.

Because the diaphragm valve 50 is so constructed as described above, when the diaphragm valve 50 is closed as shown in FIG. 6A or 6B, air (operating fluid) supplied from the micro valve 53 is supplied to the supply port 50*f*. When the supply pressure of air overcomes the compression force of the operation adjusting spring 50*i* as the air supply flow rate increases, the operation adjusting valve body 50*h* rises up to raise the metal diaphragm 50*e*, finally resulting in separation of the metal diaphragm 50*e* from the valve seat 50*c* (See FIGS. 7A and 7B). This separation causes the primary port 50*a* to communicate to the secondary port 50*b*, so that the drying gas flows into the secondary port 50*b* from the primary port 50*a*, thereby resulting in the drying gas to be supplied to the processing chamber 35.

Figure 8:
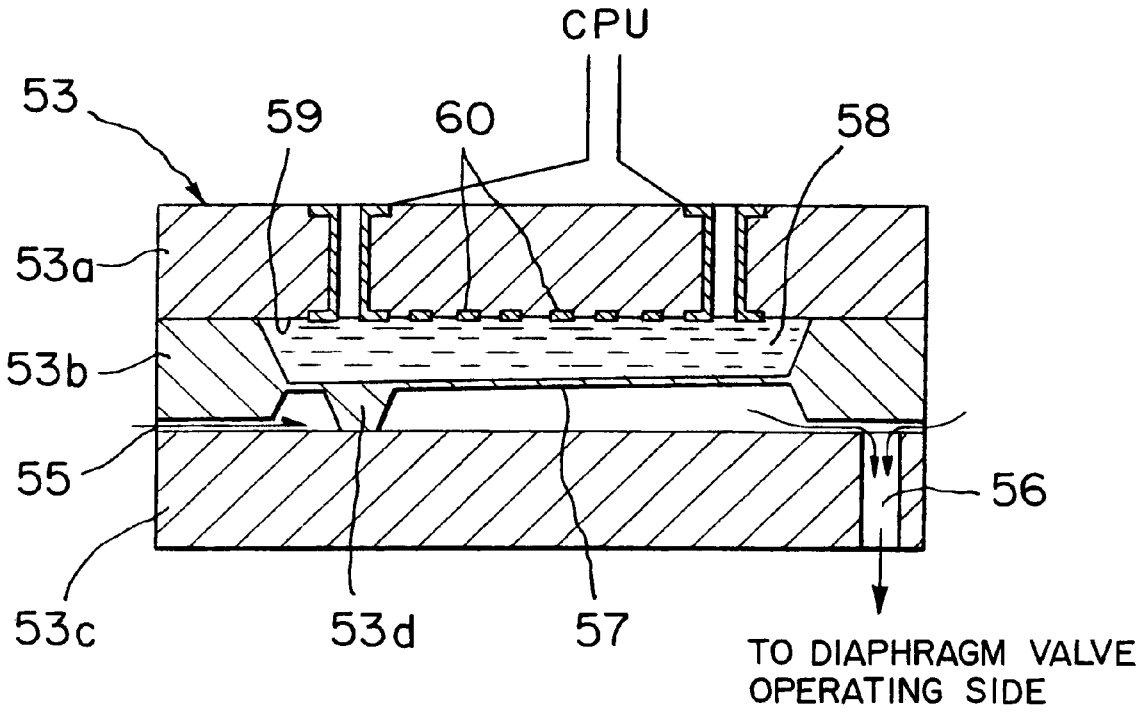
FIG. 8 is the schematic sectional view showing a micro valve, that is one example of the operating means of the invention.
Figure 9:
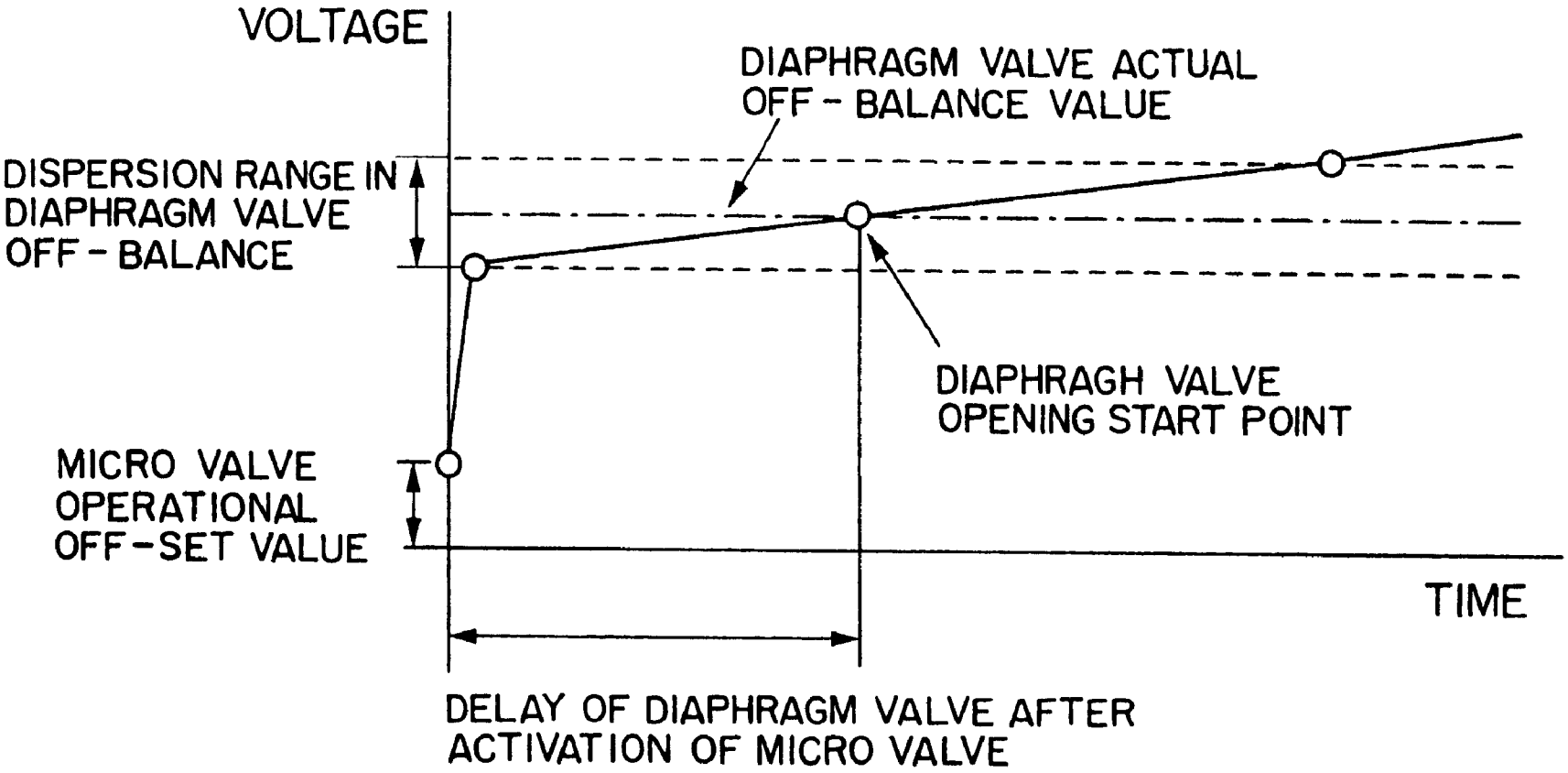
FIG. 9 is a graph showing a relation between time and voltage of the above micro valve.
Figure 10A:
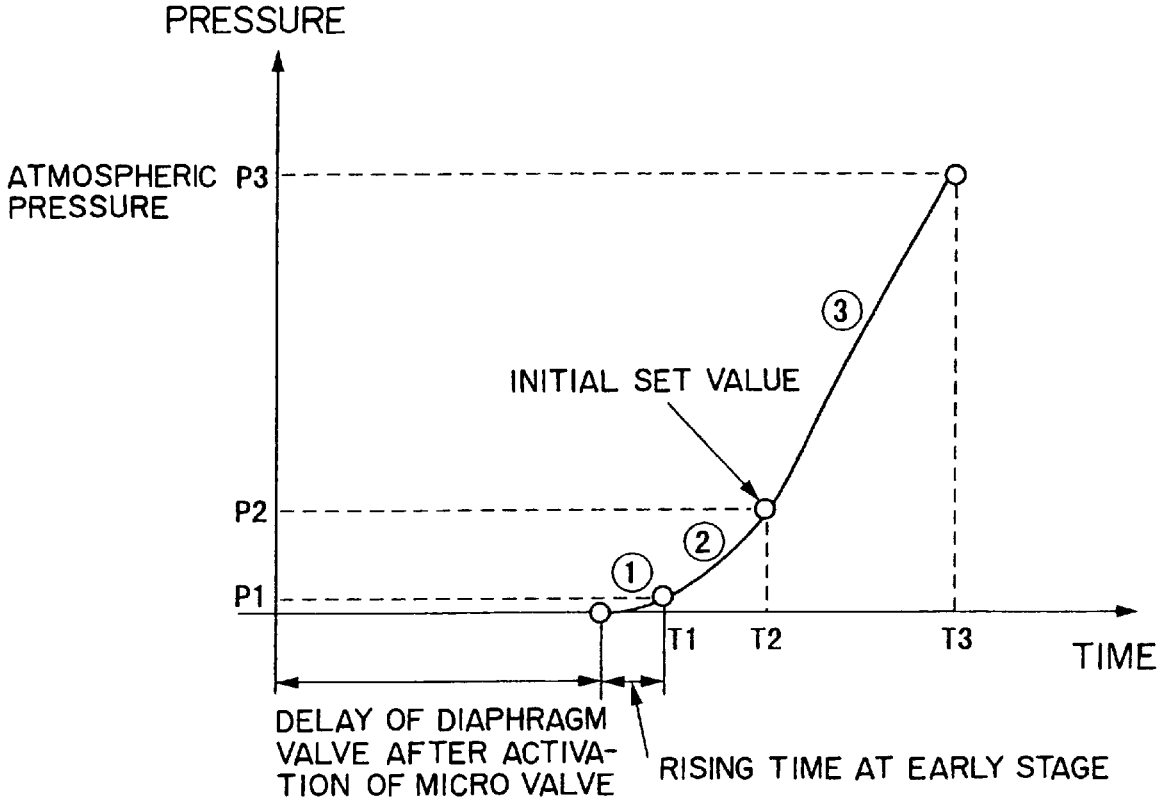
FIG. 10A is a graph showing a relation between time and pressure of the above micro valve.
Figure 10B:
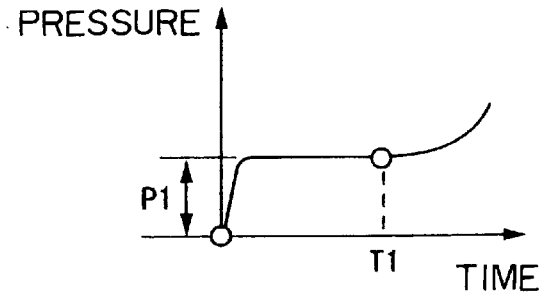
FIG. 10B is a graph showing the relation at a portion "1" in FIG. 10A.

As shown in FIG. 8, the micro valve 53 is configured as follows: An exit passage 56 is so machined in the micro valve 53 as to communicate to an air (operating fluid) intake passage 55 of the diaphragm valve 50. A housing chamber 59 is so formed in a surface opposite to the exit passage 56 as to accommodate thermal-expansive oil (control liquid) 58 via a flexible (partition) member 57. A plurality of resistance heaters 60 are disposed on a surface facing the flexible member 57 in the housing chamber 59. The flexible member 57 has intermediate members 53*b* inserted in between an upper member 53*a* and a lower member 53*c* at its both sides, and a block 53*d* to come into close contact with the lower member 53*c*. A flexible deformation of the flexible member 57 can cause the intermediate member 53*b* to open or close the exit passage 56. The whole of the micro valve 53 is made of silicon.

According to such configuration as described above, when signal from the CPU 52 and control signal of a control board 54A are subject to digital/analog conversion and sent to a resistance heater 60, not only the resistance heater 60 is heated, but also the thermal-expansive oil (control liquid) 58 will expand (or shrink), so that the flexible member 57 will go out from or come into the intake side so as to open the top of the exit passage 56, thereby controlling air (operating fluid) pressure. Therefore, the air (operating fluid) delay-controlled by the micro valve 53 will activate the diaphragm valve 50, so as to compare the pre-stored data in the CPU 52 with the secondary pressure of the micro valve 53 or the pressure in the processing chamber 35, so that an opening degree of the diaphragm valve 50 can be so controlled as to supply $N_2$ gas into the processing chamber 35, thereby achieving time-basis control of pressure recovery in the processing chamber 35.

The drying gas supply line 31*d* is provided with a filter 61 at the downstream (secondary) side of the diaphragm valve 50 so as to supply drying gas with minimum particles. Around the drying gas supply line 31*d*, a heater 62 for heat retention is provided to maintain the temperature of IPA gas to constant. A temperature sensor 63 (temperature detection means) is provided at the processing chamber 35 side of the drying gas supply line 31*d* to measure the temperature of the IPA gas flowing in the drying gas supply line 31*d*.

Figure 5:
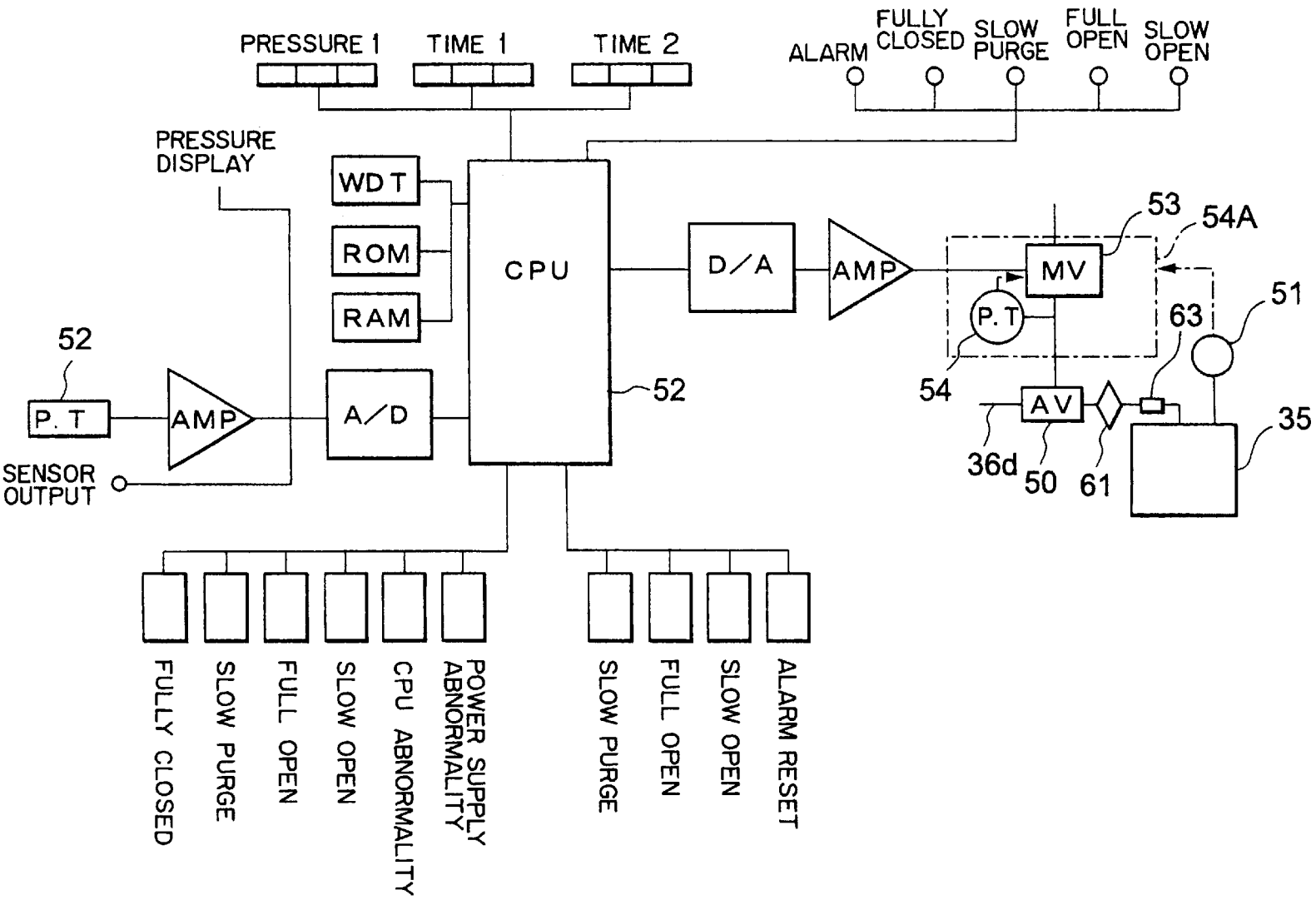
FIG. 5 is a schematic diagram showing the control system of the pressure control device according to the invention.

As shown in FIG. 5, the CPU 52 is wired to the micro valve 53 through a D/A converter and amplifier (AMP), and has a function to make PID (proportional, integration and derivative) control of the pressure sensor 51 and the pressure converter 54 via the AMP and the D/A converter, based on detection signals supplied from the pressure sensor 51 and the pressure converter 54 and data pre-stored in WDT (Watchdog Timer), ROM and RAM. Furthermore, the CPU 52 is wired to three digital switches (pressure 1 and times 1 and 2); five LEDs (alarm, fully-closed, slow purge, full-open and slow open); six relay output signals (fully-closed, slow purge, full-open, slow open, CPU abnormality and power supply abnormality); and four photo couplers (slow purge, full-open, slow open and alarm reset).

Figure 13:
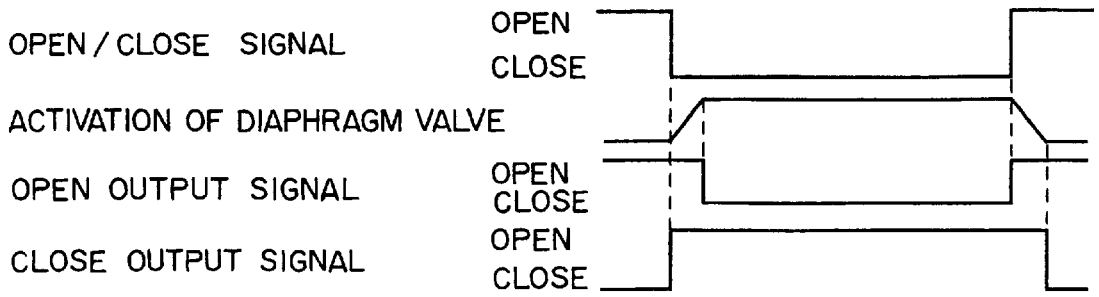
FIG. 13 is a time chart for control of input/output signals in the open/close modes.
Figure 14:
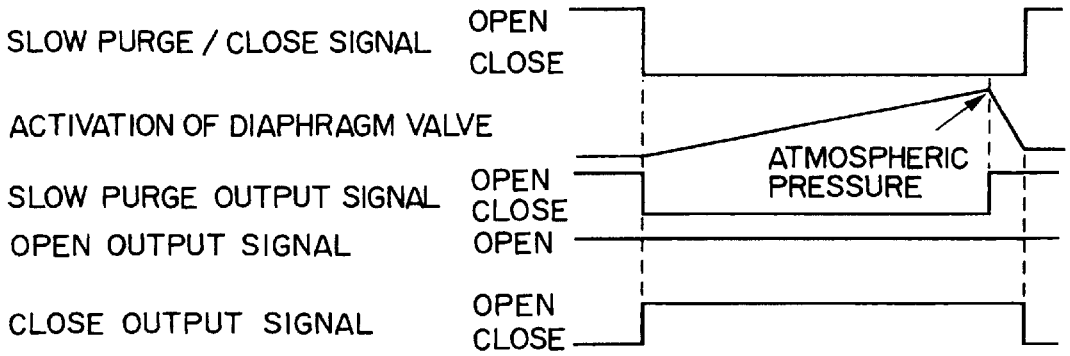
FIG. 14 is a time chart for control of input/output signals in the slow purge mode.
Figure 15:
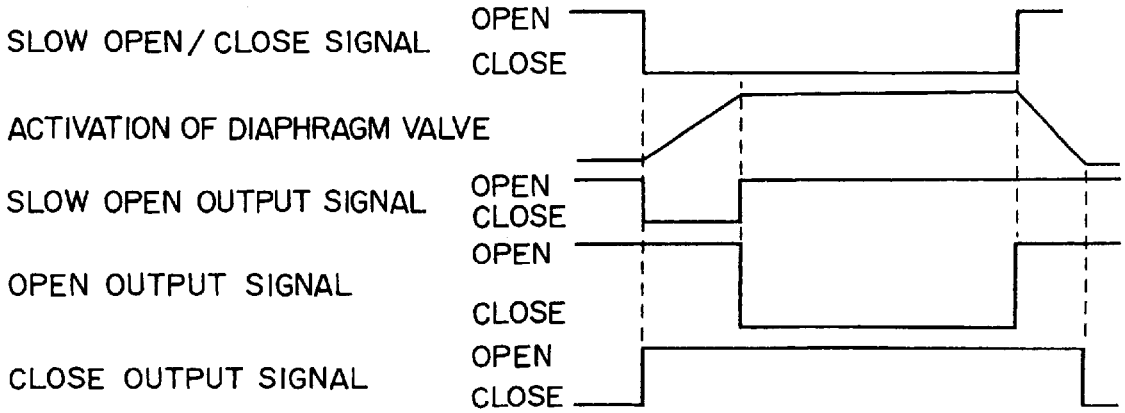
FIG. 15 is a time chart for control of input/output signals in the slow open mode.

Now, description is made for the control method of pressure and flow rate according to the invention, referring to FIGS. 9 to 15:

First of all, at the condition under which adequately cleaned wafers W were transferred to the processing chamber 35, and have been completely dried at atmosphere under the target pressure (that is depressurized atmosphere), according to the Open/Close Mode shown in FIG. 13, the micro valve 53 is activated, and the diaphragm valve 50 is controlled based on signals from CPU 52. At this instant, like the Slow Purge Mode shown in FIG. 14, the atmosphere in the processing chamber 35 is subject to delay control stepwise for a plurality of (e.g., two) preset target values as far as the atmosphere reaches a target pressure (e.g., atmospheric pressure). Furthermore, the diaphragm valve 50 is keeping the action based on the control signal for controlling valve opening speed, so as to supply the $N_2$ gas flowing in the drying gas supply line 31*d* into the processing chamber 35. When the pressure in the processing chamber 35 reaches atmospheric pressure, like the Slow-Open Mode shown in FIG. 15, the opening speed of the diaphragm valve 50 is slowed down to supply the $N_2$ gas into the processing chamber 35 slowly.

In this case, the micro valve 53 is at the offset state until the predetermined voltage is applied. Therefore, as described above, after the predetermined voltage has been applied, the resistance heater 60 is heated to cause the oil 58 to expand (or shrink), thereby displacing the flexible member 57 toward the intake side, and then air (operating fluid) flows into the supply port 50*f* in the diaphragm valve 50, thus causing the diaphragm valve 50 to start to open. In this instant, at the activation (startup) time of the micro valve 53, the pressure converter 54 detects the secondary pressure of the micro valve 53, and the detection signal is fed back to the micro valve 53 so as to control (the first control) the opening speed of the diaphragm valve 50, thereby achieving a slow opening of the diaphragm valve 50 within a proper dispersion range of the off-balance of the diaphragm valve 50 (See FIGS. 9 and FIGS. 10A-① and 10B). Next, PID control (the second control) is carried out up to a predetermined target value (for example, a critical value (P2, T2) at which drying gas flow speed starts to slow down), aiming at an adequate functional approximation line (such as a secondary degree curve) as an ideal value (see FIG. 10A-②). Finally, a control (the third control) is carried out so as to have an adequate functional approximation (e.g., linear approximation) until the pressure in the processing chamber 35 reaches atmospheric pressure (P3, T3) from the above predetermined target value (P2, T2) (see FIG. 10A-③).

Figure 11:
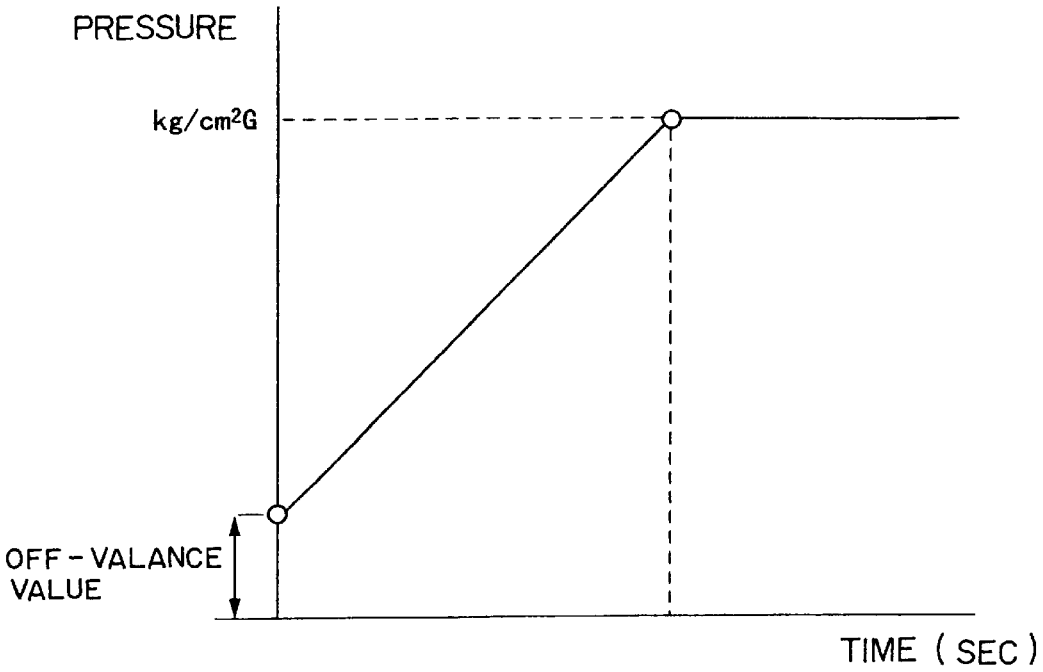
FIG. 11 is a graph showing a relation between pressure and time in the open mode.
Figure 12:
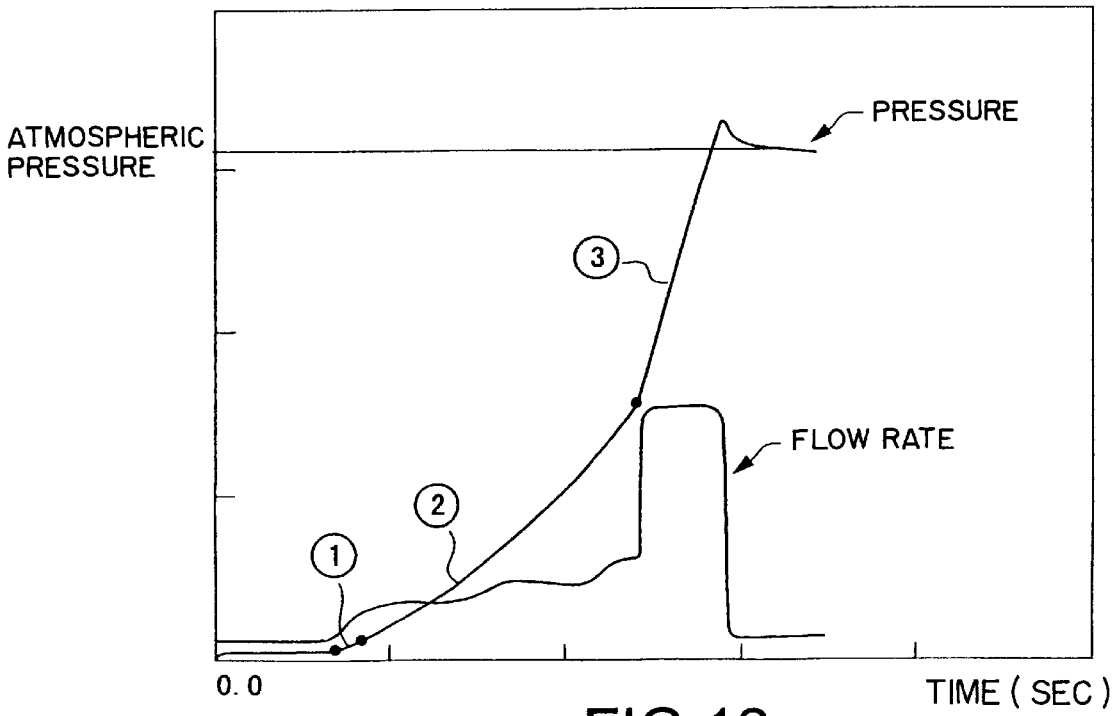
FIG. 12 is a graph showing a relation between time, pressure and flow rate in the pressure control method.

Furthermore, as shown in FIG. 11, at the condition where the pressure in the processing chamber 35 reached atmospheric pressure, a slow control of opening speed of the diaphragm valve 50 can prevent spike-like high-speed flow from being produced, even when a relatively large flow of supply of the drying gas is required.

In such a way as described above, the watching of secondary pressure of the micro valve 53 for control thereof at the operation startup time of the diaphragm valve 50 can suppress a rapid pressurizing of the processing chamber 35 at the operation startup time of the diaphragm valve 50, that is, at the initial stage of operation when pressure control is difficult due to a large volume of the processing chamber 35. Therefore, not only the generation of spike-like high-speed flow due to rapid supply of $N_2$ gas to the processing chamber 35 can be prevented, but also attachment of particles to wafers W due to rising of particles can be minimized. Furthermore, the following PID control (e.g., on the basis of a curve of secondary degree) to be continued up to the predetermined target value (for example, a critical value (P2, T2) when the flow speed of drying gas starts dropping) can suppress a rapid supply of the drying gas which may be caused by a so-far depressurized atmosphere in the processing chamber 35, thereby resulting in minimization of damage of wafers W due to vibration thereof (see FIG. 12). In addition, a linear approximation control (for example) to be performed after the flow speed of drying gas has dropped to the critical value can speed up the supply of drying gas to accelerate drying of wafers W.

Moreover, a moderate control of opening speed of the diaphragm valve 50 to be performed after the time when the pressure in the processing chamber 35 reached atmospheric pressure can prevent not only a spike-like high-speed flow of $N_2$ gas from being produced, which may take place when a large flow rate of $N_2$ gas is supplied under atmospheric pressure, but also attachment of particles to wafers W due to rising of particles.

In such a way as above, the depressurized atmosphere in the processing chamber 35 can be adequately controlled up to a target value such as atmospheric pressure. However, at the time when the system is started up or the micro valve 53 is switched over, an off-balance (an operating air pressure at the opening startup time of valve) of the diaphragm valve 50 may change, thereby causing a change in a time up to the opening start (activation time: an elapsed time up to T1 in FIG. 10A) of the diaphragm valve 50, thus resulting in a possible change of characteristics of valve approximate to curve of secondary degree.

Figure 16:
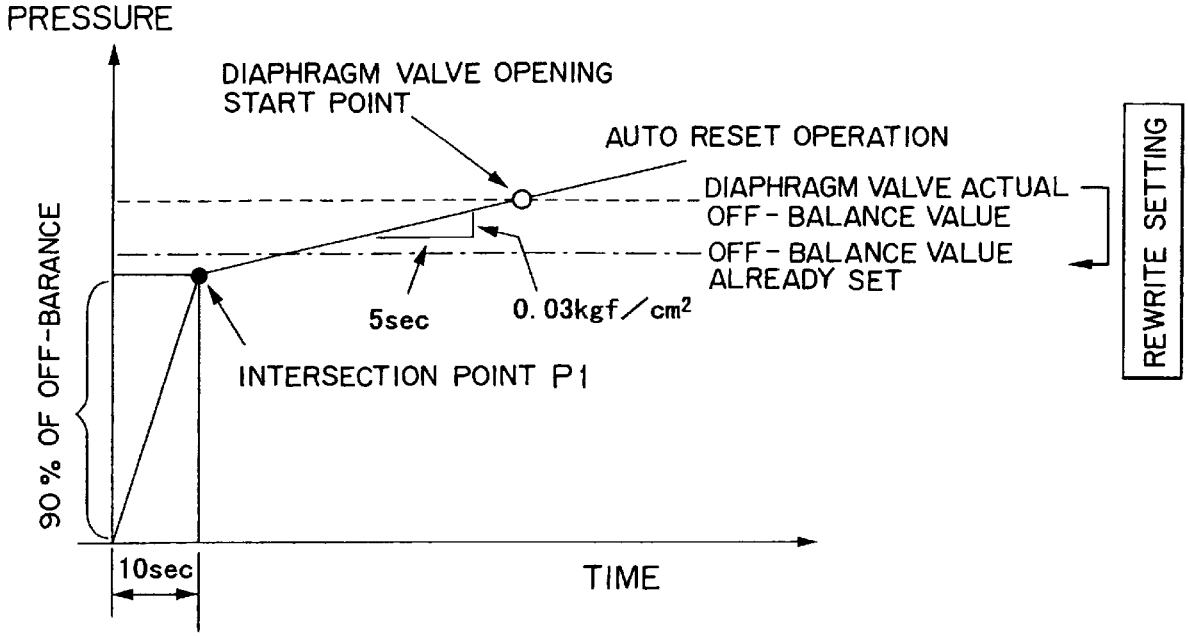
FIG. 16 is a graph showing a relation between pressure and time in the auto reset mode.

To prevent this change from taking place, this invention prepares such an Auto Reset Mode as follows: This Auto Reset Mode changes gradually the operating air pressure for the diaphragm valve 50 (opening degree adjusting means), and when an actual operating air pressure (Auto Balance) at the starting time of opening of the diaphragm valve 50 is detected, re-writes the stored value in CPU 52. More particularly, as shown in FIG. 16, a time axis-change of the operating air pressure is controlled by CPU 52 in a pattern which consists of two broken lines. The intersection point P1 of the two lines is set to approximately 10 sec (on the time axis) after the start of the mode, so that the operating air pressure at P1 be 90% of the original off-balance of the diaphragm valve 50. Furthermore, after passing the intersection point P1, the operating air pressure is increased by 0.03 kgf/cm$^2$ at every cycling time of 5 sec. Judgment of adequacy of the actual off-balance value of the diaphragm valve 50 in the Auto-Reset Mode is made as follows: CPU 52 is always watching the change of the pressure sensor 51 during the mode, and when the change exceeds a preset value (for example, 10 mV), it is judged that the diaphragm valve 50 just started to open. Then, the operating air pressure at that instant is taken as an actual off-balance value. And, the actual off-balance value thus obtained is overwritten on CPU 52 in place of the preset value for storage, thereby obtaining more realistic (optimum) pressure change characteristics in the processing chamber 35.

The diaphragm valve 50 may have a gradual change in off-balance due to extended time of repetitive operations. This change in off-balance may cause a characteristic change of approximation to curve of secondary degree as well. In fear of the possible characteristic change, this invention provides such a control (learning) function as follows: Every time when the diaphragm valve 50 is activated, the off-balance is detected. And, when it deviates from a predetermined range, the control constant in CPU 52 is so changed as to maintain the ideal (optimum) pressure change characteristics in the processing chamber 35 while following the change of off-balance.

Figure 17:
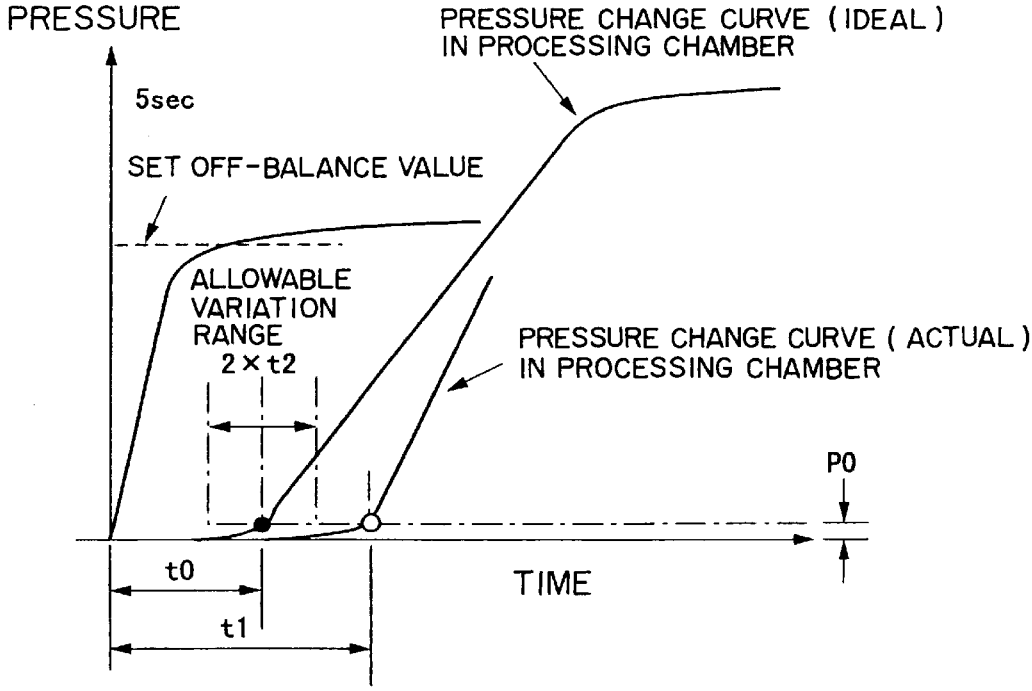
FIG. 17 is a graph showing a relation between force and time, which shows a control function enough to maintain the pressure change characteristics of an ideal processing chamber.

As shown in FIG. 17, this learning function places its judgment point at (t0, P0). When (t1−t0) is larger or smaller than t2, the preset off-balance value is increased or decreased. In such a way, this learning function intends to make revision control of the starting time of the diaphragm valve 50 by keeping pace with the timing variation of the off-balance pressure thereof. More specifically, when actual starting time is out of (allowable variation time + or −3 sec., or 2×t2 in FIG. 17) from the standard time t0 of the ideal pressure change curve (for example, an output voltage of the pressure sensor 51 is 10 mV, at time of 20 sec. after activation), this learning function increases or decreases the preset off-balance value by 0.03 kgf/cm$^2$, and the revised off-balance value is over-written in CPU 52, thereby expecting more ideal or optimum pressure change characteristics in the processing 35 for successive operation.

The embodiments of the invention employ the micro valve (operating means) which changes electrical signal to a flow rate of air (operating fluid). The operating means is not limited to the micro valve, but may be a proportional solenoid valve (see FIG. 18), provided that electrical signal is changed to air flow rate.

Figure 18:
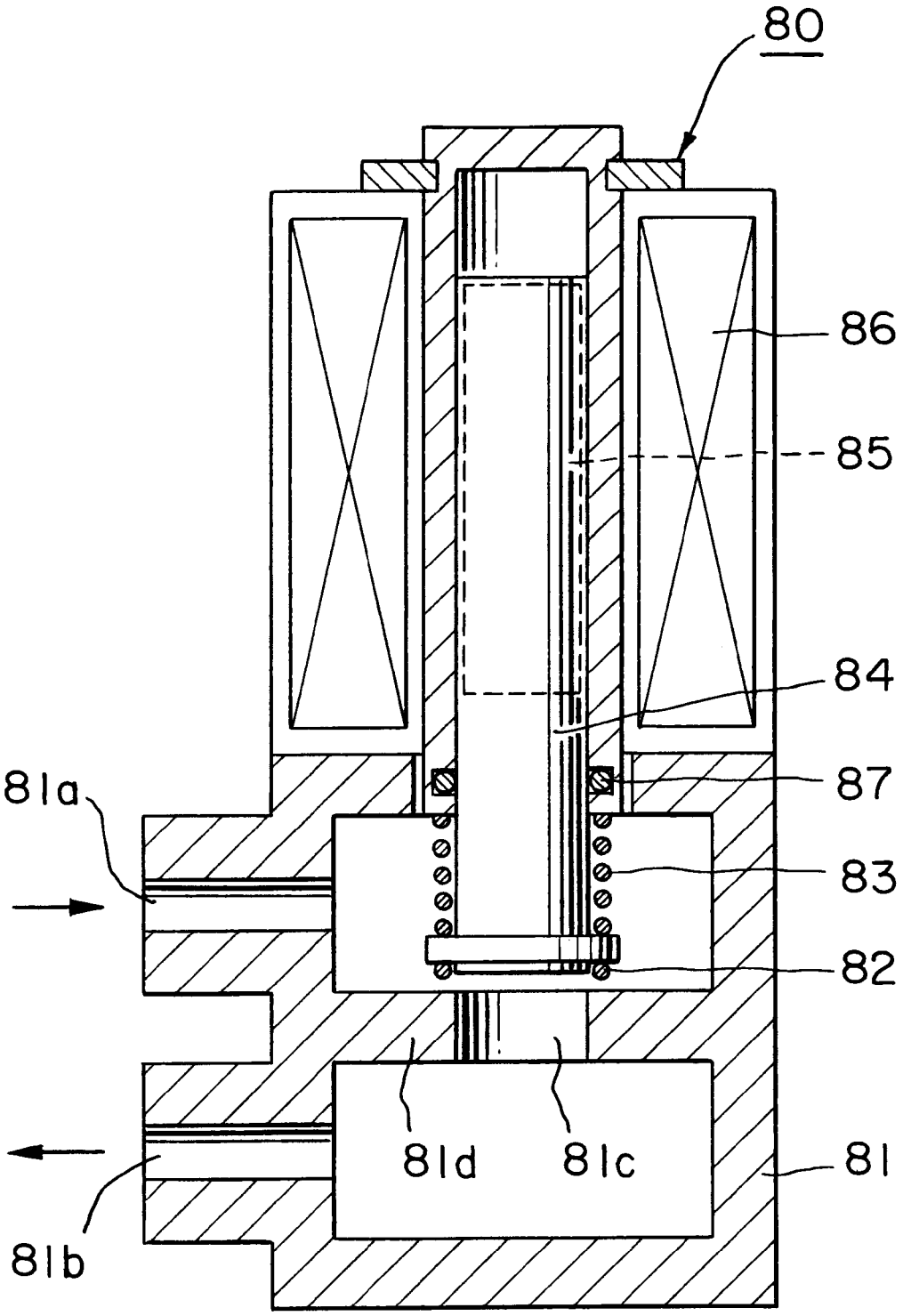
FIG. 18 is a schematic sectional view showing another control means, or a proportional solenoid valve.

As shown in FIG. 18, the proportional solenoid valve 80 consists mainly of a valve assembly 81 which has a valve seat 81*d* in the passage 81*c* communicating a primary port 81*a* connected to the drying gas supply line 31*d* and a secondary port 81*b*; and a valve sheet 82 seating on the valve seat 81*d*; as well as a valve stem 84 normally depressed to close the valve by the compression force of a spring 83; a solenoid 85 loaded integrally around the valve stem 84; and a coil 86 loaded around the valve assembly 81 so as to surround the solenoid 85. An O ring 87 is inserted in between the valve stem 84 and the valve assembly 81, to hermetically isolate the passage 81*c* side from the coil 86.

With the proportional solenoid valve 80 having such a configuration, when the coil 86 is energized, the solenoid 85 is magnetized, thereby lifting up (in FIG. 18) the valve stem 84 against the compressive reaction of the spring 83, thus resulting in a separation of the valve sheet 82 from the seat 81*d*. This causes the primary and secondary ports 81*a* and 81*b* to communicate to the other, so that drying gas flows into the processing chamber 35 through the secondary port 81*b* from the primary port 81*a*.

According to the above embodiment of the invention in FIG. 18, the pressure sensor 51 is provided at the processing chamber 35 side, to detect the pressure in the processing chamber 35. Based on the detection signal of the pressure, the micro valve 53 and the diaphragm valve 50 are controlled. But, as shown in FIG. 3 by two-dot chain line, a pressure sensor 51A may be inserted in the drying gas supply line 31*d* connecting the diaphragm valve 50 and the processing chamber 35 to detect the secondary pressure of the diaphragm valve 50 and control both valves 50 and 53 based on the detected signal. In this case, both of the pressure sensors 50 and 50A may be used or either one will do.

Furthermore, the above description of the embodiment of the invention shows an example in which a processing chamber 35 under atmosphere lower than target pressure (e.g., vacuum pressure or depressurized atmosphere) is restored to the target pressure (e.g., atmospheric pressure). This application is not limited to the above case, but a processing chamber 35 under atmosphere higher than target pressure (e.g., atmospheric pressure) may be restored to the target pressure (e.g., vacuum pressure).

Figure 19:
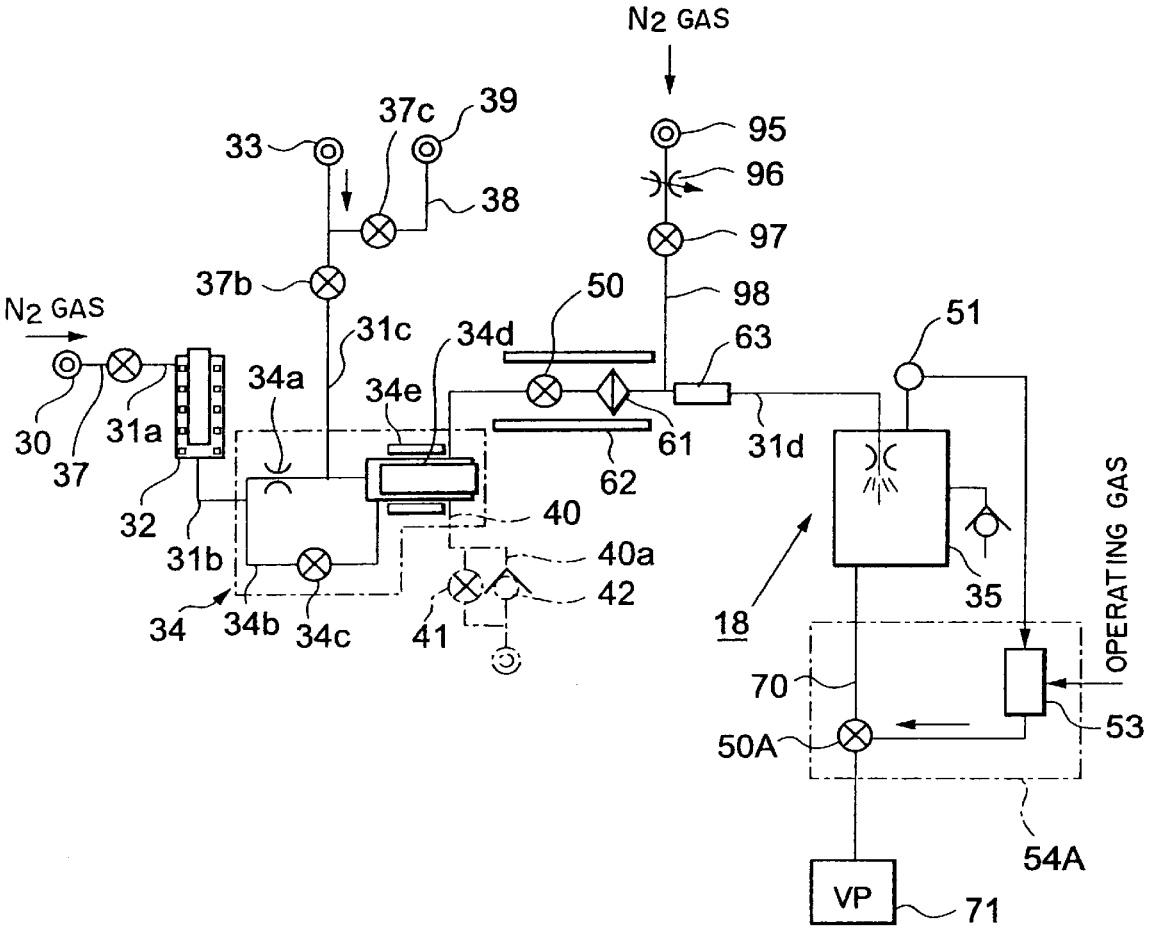
FIG. 19 is a schematic block diagram showing another embodiment of pressure and flow rate control device according to the present invention.

In detail, as shown in FIG. 19, a diaphragm type of vacuum vent valve 50A (opening degree adjusting means) may be provided in a fluid vent line 70 connected to the bottom of the processing chamber 35. A vacuum pump VP 71(vacuum venting means) is connected to the vacuum vent valve 50A. This configuration may be applied to a depressurization system in which, while performing the opening/closing operation of the vacuum vent valve 50A, the processing chamber 35 is restored to a predetermined pressure lower than the target pressure (e.g., depressurized atmosphere) from the target pressure (e.g., atmospheric pressure). In this case, the vacuum vent valve 50A has the similar configuration to the above described one, and similarly to the above embodiment, the vacuum vent valve 50A is controlled based on detection signal from the pressure sensor 51 and control signal fed back from the pressure transducer (not shown) of the micro valve 53 (operating means).

Figure 21:
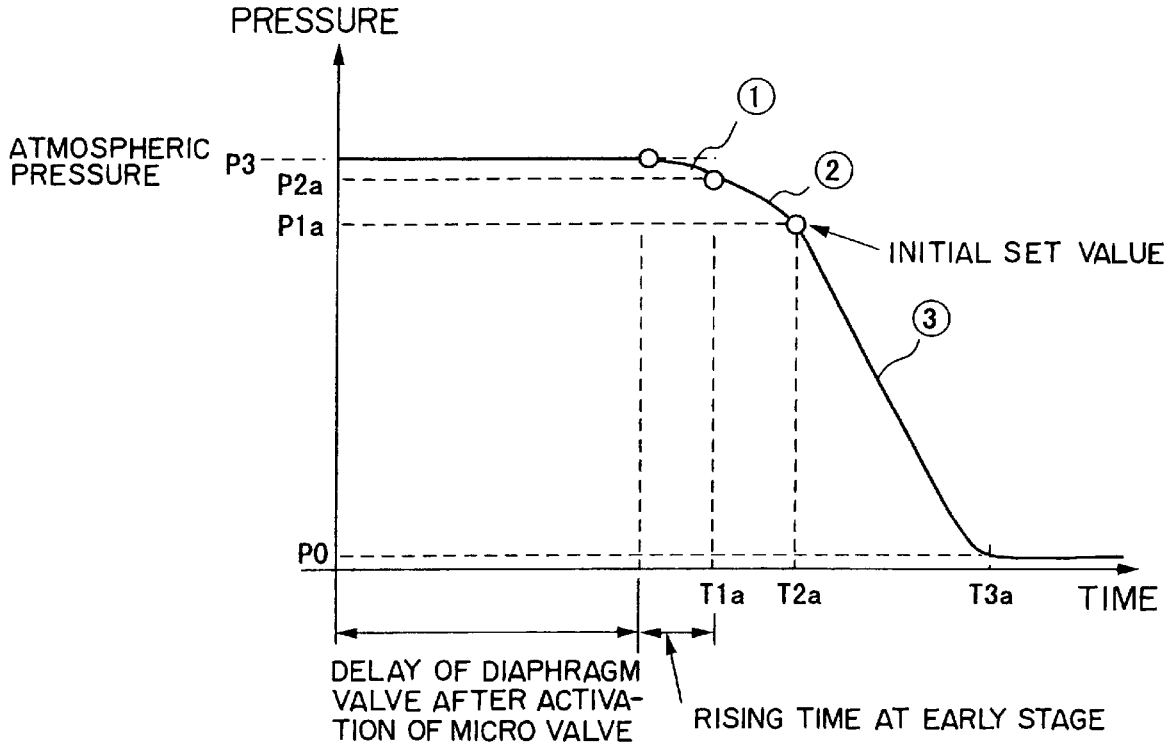
FIG. 21 is a graph showing a relation between time and pressure of micro valve.
Figure 22:
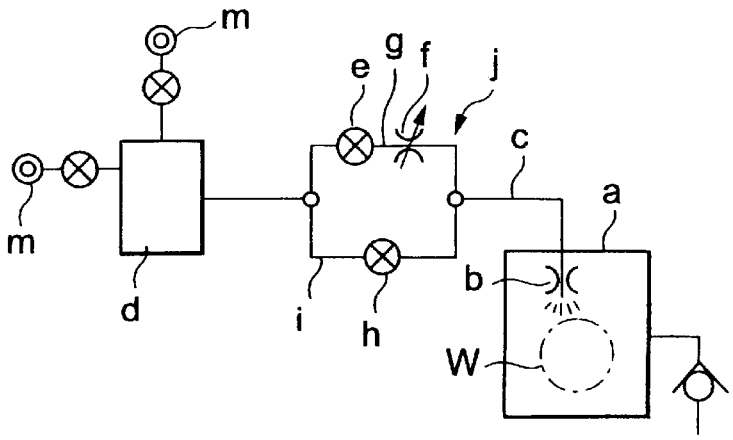
FIG. 22 is a schematic block diagram showing a pressure control device according to the prior art.
Figure 23:
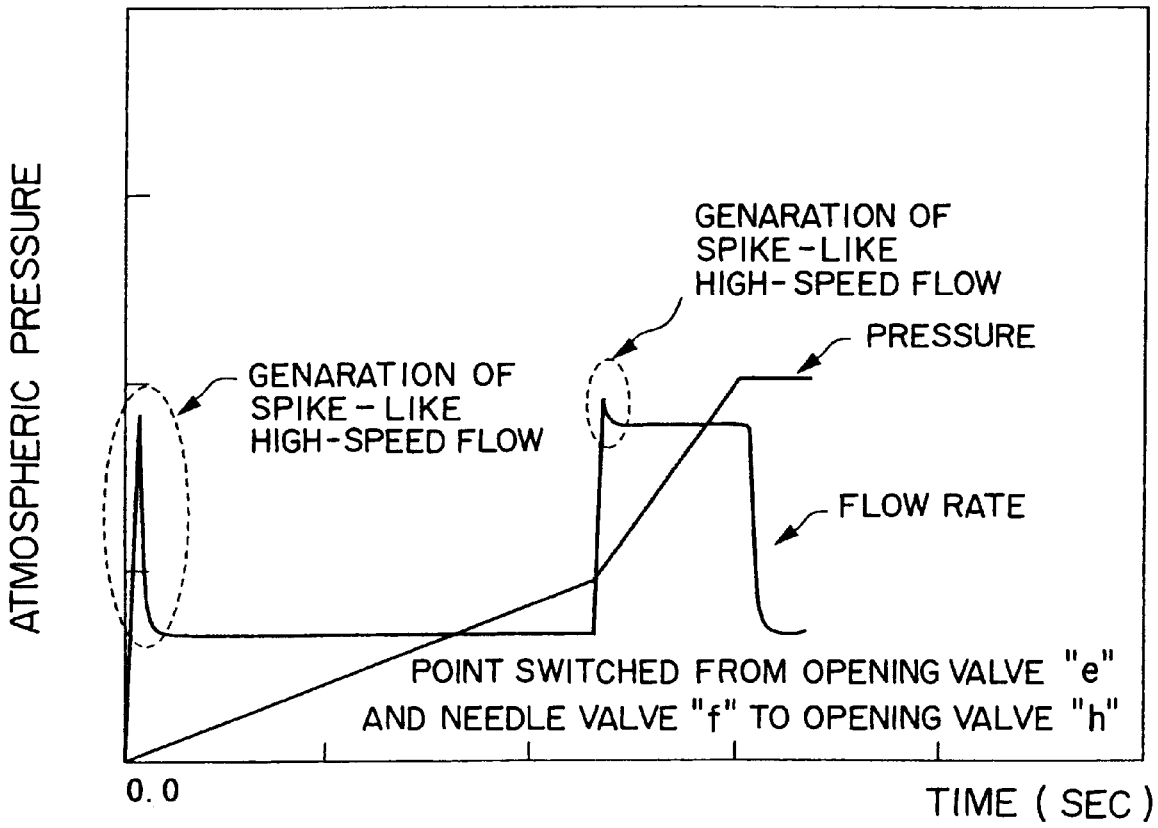
FIG. 23 is a graph showing a relation among time, pressure and flow rate in a control method according to the conventional pressure control device.

Such a configuration as described above can previously set a plurality of target values (pressure in the processing chamber and vacuum venting time) to control the vacuum vent valve 50A. More particularly, the secondary pressure of the micro valve 53 can be detected by a pressure transducer (not shown) when activating (starting up) the micro valve 53, and the detection signal is fed back to the micro valve 53 to control (the first control) the opening speed of the vacuum vent valve 50A, thereby opening the vacuum vent valve 50A gradually within a proper dispersion range of the vacuum vent valve 50A (see FIG. 21-①). After PID control (the second control) is performed up to a predetermined value (for example, a critical value (P2*a*, T2*a*) at which the drying gas flow speed is beginning to rise) toward an ideal value of curve of secondary degree (see FIG. 21-②), an adequate function approximation (for example, linear approximation) control (the third control) can be performed until the processing chamber 35 is depressurized to a value (P0, T3*a*) from the predetermined target value (P2*a*, T2*a*) (see FIG. 21-③).

Therefore, a rapid vacuum venting of the processing chamber 35 from atmospheric pressure by opening the vacuum vent valve 50A can prevent the gas in the processing chamber 35 from instantly being brought to high-speed hydrodynamic condition, and prevent the rising of particles and the vibration of wafers W.

In this connection, in FIG. 19, since other parts are the same as the first embodiment shown in FIG. 3, description of the identical parts is omitted with the same Nos. attached.

As for the above-described embodiments, description is made for single-purpose devices for two following cases: (1) restoration of the processing chamber 35 to a target pressure (e.g., atmospheric pressure) from a pressure lower than target pressure (e.g., depressurized atmosphere) (see FIGS. 3 and 4); and (2) restoration of the processing chamber 35 to a target pressure (e.g., depressurized atmosphere such as vacuum) from a pressure higher than target pressure (e.g., atmospheric pressure) (see FIG. 19). But, both may be combined into one device.

Figure 20:
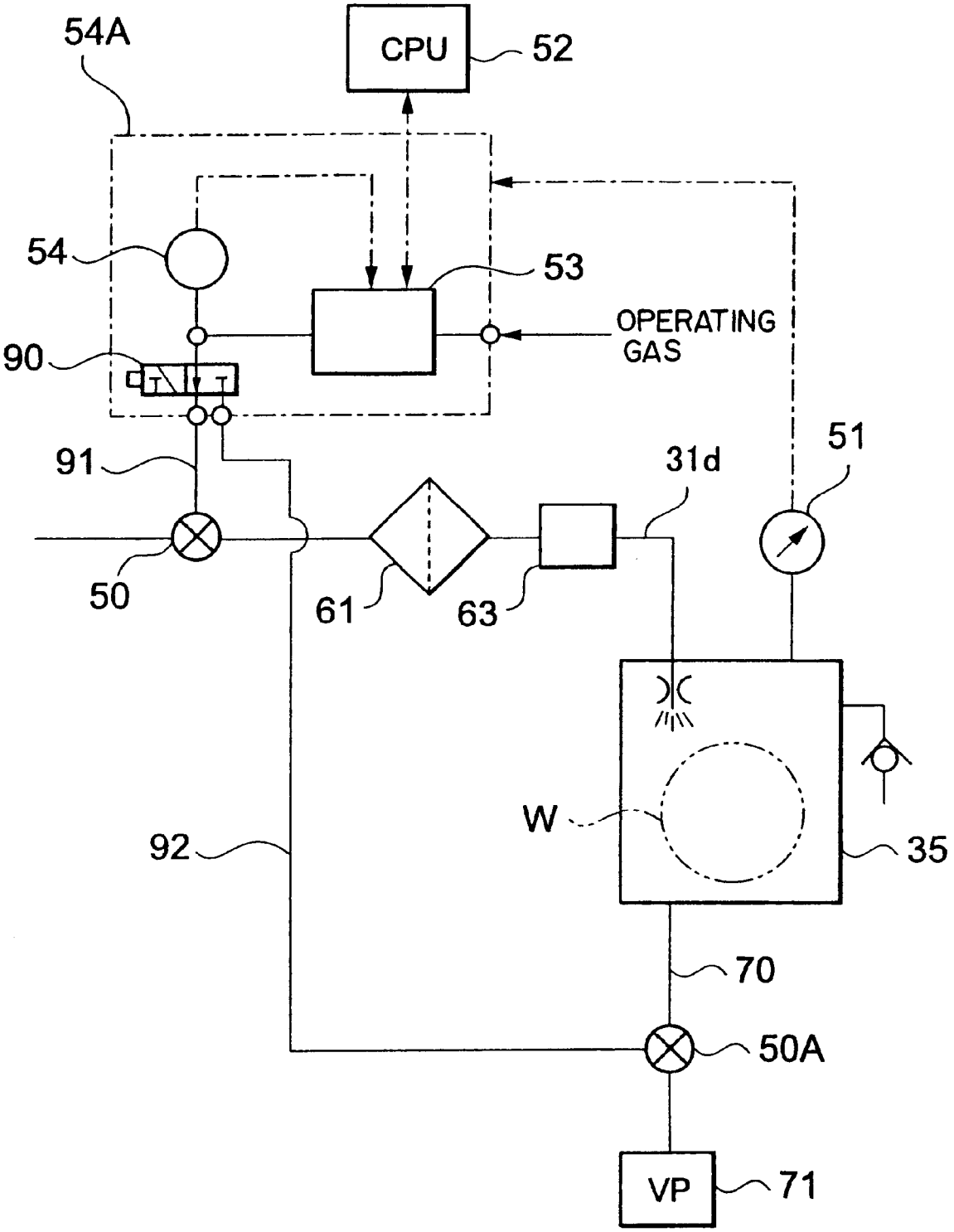
FIG. 20 is a schematic block diagram showing a separate embodiment of pressure and flow rate control device according to the present invention.

In detail, as shown in FIG. 20, not only both of the diaphragm valve 50 (opening adjusting means) to be provided in the fluid supply line 31*d* connected to the top of the processing chamber 35 and the diaphragm type of vacuum vent valve 50A (another opening adjusting means) to be provided in the fluid venting line 70 connected to the bottom of the processing chamber 35 may be controlled (like the above embodiment) based on a detection signal from the pressure sensor 51 and control signals fed back from CPU 52 (control means) for comparing and calculating the detection signal from the pressure sensor 51 and data prestored therein, and from the pressure transducer 54 of the micro valve 53 (operating means), but also either one of the diaphragm valve 50 and the vacuum vent valve 50A may selectively be controlled by the solenoid selector valve 90 (switching means).

In this case, the diaphragm valve 50 and the vacuum vent valve 50A are wired to the operation signal side of the micro valve 53 via first and second operation signal transfer channels 91 and 92, respectively, and air (operating fluid) is supplied to the diaphragm valve 50 or the vacuum vent valve 50A by switching operation of the solenoid selector valve 90 provided in operating signal transfer channels 91 and 92, so as to control the diaphragm valve 50 or the vacuum vent valve 50A.

According to such configuration as described above, switching operation of the solenoid selector valve 90 can selectively restore the processing chamber 35 under atmosphere lower than the target pressure (e.g., depressurized atmosphere) to the atmosphere higher than the target pressure (e.g., atmospheric pressure), or the processing chamber 35 under atmosphere higher than the target pressure (e.g., atmospheric pressure) to the target pressure (e.g., vacuum and other depressurized atmosphere). Therefore, this configuration can widely utilize the pressure controller related to the invention, and substantially miniaturize this system.

In this connection, in FIG. 20, other parts are the same as those embodiments shown in FIGS. 3, 4 and 19, so that description of the same parts is omitted with the same Nos. attached.

The above description of the embodiments is made for the case where the pressure control methods and devices according to the invention are applied to a cleaning/drying system of semiconductor wafers, but they can be applied also to a film-making system which is to be processed under vacuum atmosphere; a processing system which supplies a fluid into a processing chamber under vacuum atmosphere; and other various systems which are to be processed under vacuum atmosphere.

Description was made referring to FIG. 19 for the depressurizing system in which the target pressure (e.g., atmospheric pressure) is restored to a predetermined pressure lower than the target pressure (e.g., depressurized atmosphere). In this case, a too rapid vacuum evacuation from atmospheric pressure may induce an adiabatic expansion of gas in the processing chamber 35, thereby causing gas temperature to be lowered rapidly, thus resulting in dew condensation of moisture remaining therein. Even other liquids than water (moisture) may condense if their vapor temperature is low. This condensation may cause impurities in the processing chamber 35 to come together for attachment. For example, semiconductor wafers cleaned and dried therein may introduce a low yield of semiconductor elements.

As shown in FIG. 19, the control system of pressure and flow rate according to the invention can solve the above problems as follows: Thermal energy supplementary gas such as nitrogen or argon gas at room temperature is supplied in the drying gas supply line 31*d* (provided in between the filter 61 and the temperature sensor 63), through the gas supply line 98 via the throttle valve 96 and the diaphragm valve 97, from the gas supply source 95.

As described above in detail, the control method for pressure and flow rate according to the invention controls the opening speed of the opening degree adjusting means for the opening valve of fluid flowing into or vented from the processing chamber as follows: (1) during the first period, control is made up to the first target value with a predetermined first functional approximation line as ideal value; and (2) for the rest of periods, control is made stepwise to two or more target values previously set. More specifically, (1) during the rest of period before the first period, the control of opening speed is made up to the second target value among the plural target values, based on a control input of the opening degree adjusting means; and (2) during the rest of period after the first period, the control is made toward the predetermined second functional approximation line (as ideal value) which has a larger change than the first functional approximation line, until the above target pressure is attained from the second target value.

Under depressurized atmosphere or atmospheric pressure, the control method according to the invention can suppress a spike-like high-speed flow which may otherwise take place in the supply or exit of a large flow rate of fluid. The control method can solve the problems caused by the spike-like high-speed flow which raises particles, thereby resulting in attachment of particles for example to semiconductor wafers.

What is claimed is:

1. A control method for pressure and flow rate by which a processing chamber under atmosphere higher or lower than the target pressure is restored to the target pressure, comprising the steps of:

controlling, during a first period, an opening speed of an opening degree adjusting means provided in a pipe communicating to the processing chamber to a first target value toward a predetermined first functional approximation line as an ideal value; and controlling, during other periods except the first period, the opening speed stepwise to two or more predetermined target values to control a pressure and flow rate in the pipe so that the processing chamber reaches the target pressure.

2. The control method for pressure and flow rate as claimed in claim 1, further comprising the step of controlling, during a period among the other period and before the first period, the opening speed to a second target value among the two or more target values, based on a control amount of the opening degree adjusting means.

3. The control method for pressure and flow rate as claimed in claim 1, further comprising the step of controlling, during a period among the other periods and after the first period, the opening speed toward a second predetermined functional approximation line as an ideal value and having a larger change than the first functional approximation line, until a second target value among the two or more target values reaches the target pressure.

4. The control method for pressure and flow rate as claimed in claim 1, wherein the first functional approximation line is a function of secondary degree.

5. The control method for pressure and flow rate as claimed in claim 3, wherein the second functional approximation line is linear.

6. The control method for pressure and flow rate as claimed in claim 2, further comprising the step of detecting a control amount at an activation starting point of the opening degree adjusting means to set an activation starting time for the opening degree adjusting means based on the detected control amount.

7. The control method for pressure and flow rate as claimed in claim 1, further comprising the step of detecting, for every time when the opening degree adjusting means is activated, an activation starting time for the opening degree adjusting means to revise the activation starting time when the detected time reaches a predetermined value.

8. A control method for pressure and flow rate by which a processing chamber under atmosphere higher or lower than a target pressure is restored to the target pressure, comprising the steps of:

when the processing chamber is under atmosphere lower than the target pressure, controlling an opening speed of a first opening degree adjusting means provided in an inlet pipe communicating to the processing chamber to a first target value toward a first predetermined functional approximation line as an ideal value during a first period;

controlling the opening speed of the first opening degree adjusting means stepwise to two or more predetermined target values during periods other than the first period to control a pressure and flow rate in the inlet pipe so that the processing chamber reaches the target pressure, when the processing chamber is under atmosphere higher than the target pressure, controlling an opening speed of a second opening degree adjusting means provided in an outlet pipe communicating to the processing chamber to a second target value toward a second predetermined functional approximation line as an ideal value during a second period; and controlling the opening speed of the second adjusting means stepwise to two or more predetermined target values during periods other than the second period to control a pressure and flow rate in the outlet pipe, so that the processing chamber reaches the target pressure.

9. The control method for pressure and flow rate as claimed in claim 8, further comprising the step of detecting, for every time when either one of the first and second opening degree adjusting means is activated, an activation starting time of the either one of the means to revise the activation starting time when the detected activation starting time reaches a predetermined value.

10. The control method for pressure and flow rate as claimed in claim 1, further comprising the step of supplying, when the processing chamber is under atmosphere higher than the target pressure, a thermal energy supplementary gas into the processing chamber while controlling the pressure and flow rate in the pipe so that the processing chamber reaches the target pressure.

11. The control method for pressure and flow rate as claimed in claim 8, further comprising the step of supplying, when the processing chamber is under atmosphere higher than the target pressure, a thermal energy supplementary gas into the processing chamber while controlling the pressure and flow rate in the outlet pipe so that the processing chamber reaches the target pressure.

12. A method for evacuating a processing chamber to vacuum comprising the step of supplying a thermal energy supplementary gas into the processing chamber.

13. The method as claimed in claims 10, 11 or 12, wherein the thermal energy supplementary gas is nitrogen gas.

14. A control device for pressure and flow rate, comprising:

opening degree adjusting means provided in an inlet pipe communicating to a processing chamber under atmosphere higher or lower than a target pressure;

detection means for detecting a pressure in the processing chamber to output a detection signal; and control means, responsive to the detection signal, for controlling, an opening speed of the opening degree adjusting means to a first target value toward a first predetermined functional approximation line as ideal value during a first period and controlling the opening speed of the opening degree adjusting means stepwise to two or more predetermined target values to control a pressure and flow rate in the inlet pipe so that the processing chamber reaches the target pressure.

15. The control device for pressure and flow rate as claimed in claim 14, wherein, for every time when the opening degree adjusting means is actuated, the control means detects an activation starting time for the opening degree adjusting means to revise the activation starting time when the detected time reaches a predetermined value.

16. A control device for pressure and flow rate, comprising:

first opening degree adjusting means provided in an inlet pipe communicating to a processing chamber under atmosphere lower or higher than a target pressure;

second opening degree adjusting means provided in an outlet pipe communicating to the processing chamber;

detection means for detecting a pressure in the processing chamber to output a detection signal; and control means for, when the processing chamber is under atmosphere lower than the target pressure, controlling a pressure and flow rate in the inlet pipe by controlling an opening speed of the first opening degree adjusting means, during a first period, to a first target value toward a first predetermined functional approximation line as ideal value, and during periods other than the first period, stepwise to two or more predetermined target values so that the processing chamber reaches the target pressure, and when the processing chamber is under atmosphere higher than the target pressure, controlling a pressure and flow rate in the outlet pipe by controlling an opening speed of second opening degree adjusting means, during a second period, to a second target value toward a second predetermined functional approximation line as ideal value, and during periods other than the second period, stepwise to two or more predetermined target values so that the processing chamber reaches the target pressure.

* * * * *